United States Patent [19]

Sekijima et al.

[11] Patent Number: 5,025,605

[45] Date of Patent: Jun. 25, 1991

[54] MESHWORK REINFORCED AND PRE-STRESSED CONCRETE MEMBER, METHOD AND APPARATUS FOR MAKING SAME

[75] Inventors: Kenzo Sekijima; Seiho Kitagawa, both of Tokyo, Japan

[73] Assignees: Shimizu Construction Co., Ltd., Tokyo; Dainihon Glass Industry Co., Ltd., Sagamihara, both of Japan

[21] Appl. No.: 445,144

[22] Filed: Dec. 4, 1989

Related U.S. Application Data

[63] Continuation of Ser. No. 212,962, Jun. 27, 1988, abandoned.

[30] Foreign Application Priority Data

| | | | |
|---|---|---|---|
| Jun. 26, 1987 | [JP] | Japan | 62-159365 |
| Jun. 26, 1987 | [JP] | Japan | 62-159366 |
| Mar. 28, 1988 | [JP] | Japan | 63-73937 |

[51] Int. Cl.[5] ..... E04C 2/06

[52] U.S. Cl. ..... 52/309.16; 52/309.17

[58] Field of Search ..... 52/309.16, 309.17, DIG. 7, 52/650

[56] References Cited

U.S. PATENT DOCUMENTS

| | | | |
|---|---|---|---|
| 3,298,152 | 1/1967 | Lockshaw | 52/650 |
| 3,317,189 | 5/1967 | Rubenstein | 52/DIG. 7 |
| 3,466,822 | 9/1969 | Hull | 52/309.17 |
| 4,706,430 | 11/1987 | Sugita | 52/309.17 |
| 4,776,145 | 10/1988 | Dykmans | 52/309.17 |

*Primary Examiner*—John E. Murtagh

*Attorney, Agent, or Firm*—Oblon, Spivak, McClelland, Maier & Neustadt

[57] ABSTRACT

A pre-stressed concrete member which is mainly composed of (a) first reinforcement members including first fiber strands bound together and extending along a first direction; (b) a second reinforcement member including second fiber strands bound together, extending along a second direction perpendicular to the first direction, the first reinforcement members and the second reinforcement member connected to each other at their intersections so as to form a meshwork thereby, and at least one of the first members and the second member being pre-tensioned; (c) and a concrete body embedding therein the first reinforcement members and the second reinforcement member.

9 Claims, 17 Drawing Sheets

MESHWORK REINFORCED AND PRE-STRESSED CONCRETE MEMBER, METHOD AND APPARATUS FOR MAKING SAME

This application is a continuation of application Ser. No. 212,962, filed on June 27, 1988, now abandoned.

FIELD OF THE INVENTION

The present invention is related to a concrete member having meshwork-like reinforcement members pre-tensioned and embedded in the concrete member, a method for fabricating the concrete member, and an apparatus for performing the method.

BACKGROUND OF THE INVENTION

Pre-stressed concrete members are widely used because of their superior mechanical strength for their relatively light weight and possibility of suppressing cracks. In the pre-stressed or pre-tension concrete members, reinforcement member embedded therein pre-tensioned to give a compression stress to a concrete body. By virtue of this compression stress, the concrete body is kept under a compressive state of stress while the member is being loaded or not loaded. Thus, the relatively poor tensile strength of concrete is compensated.

High strength and durability are required for the concrete and the reinforcement members used in the pre-stressed concrete members because the concrete and the reinforcement member are subjected to a constant compression stress and a tensile stress, respectively. Conventionally, steel bars are used as reinforcement members. But, as it has become clear that corrosion of steel bars plays an important role in decreasing the strength of the steel bars and the bond stress between the bars and the concrete, resulting in a gradual deterioration of the mechanical performance of the pre-stressed concrete member during a long service period.

Therefore, replacement of the reinforcement members by those made of protrusion FRP (Fiber Reinforced Plastics), made by conversion, formation and strengthening of raw materials, has been proposed recently. But in order to avoid chemical deterioration of FRP reinforcement members, the FRP reinforcement members has to be post-tensioned as follows. That is, after the concrete is solidified, FRP reinforcement members are inserted in as many sheathes previously embedded in the concrete and a post-tension force is applied to the reinforcement members by jacks, for example, so that the FRP reinforcement member does not come in direct contact with the concrete. As far as the FRP reinforcement members are used, an apparatus specially designed for giving post-tension thereto is necessary. Further, the apparatus is relatively large-scaled and expensive. The demerit becomes larger when two-dimensional post-tension has to be given to the concrete member because the number of the apparatus increases, and the apparatus have to be located in a limited space.

OBJECTS OF THE INVENTION

It is an object of the pre-stressed concrete member according to the present invention to provide a concrete member which is as strong as or stronger than conventional pre-stressed concrete members and, at a same time, lighter and more durable compared to steel reinforced conventional pre-stressed members. The present pre-stressed concrete member is more simple in construction and consequently more economical compared to conventional post-tensioned concrete members reinforced by FRP reinforcement members. Further, because the reinforcement member used in the present invention has a Young's modulus smaller than that of steel, strain of the present reinforcement member becomes larger than that of the steel reinforcement members. Consequently, the pre-tension force applied by the present reinforcement member is more stable, compared to that obtained by steel reinforcement members, against dimensional changes of the concrete member which may be caused by shrinkage or creep of the concrete.

An object of the method for fabricating pre-stressed concrete members according to the present invention is to provide a most simple and effective method for fabricating the above pre-stressed concrete members.

An object of the apparatus for fabricating pre-stressed concrete member according to the present invention is to enable fabrication of the above pre-stressed concrete member according to the above-mentioned method most effectively.

SUMMARY OF THE INVENTION

In a first aspect of the present invention, there is provided a pre-stressed concrete member comprising: (a) first reinforcement members including first fiber strands bound together and extending along a first direction; (b) a second reinforcement member including second fiber strands bound together, extending along a second direction perpendicular to the first direction, the first reinforcement members and the second reinforcement member connected to each other at their intersections so as to form a meshwork thereby, and at least one of the first members and the second member being pre-tensioned and (c) a concrete body embedding therein the first reinforcement members and the second reinforcement member.

In a second aspect of the present invention, there is provided a method for fabricating a pre-stressed concrete member comprising the steps of: (a) stretching at least one first fiber means impregnated with a resin material in a first direction between first and second opposing extremities; (b) stretching at least one second fiber means impregnated with a resin material in a second direction between third and fourth opposing extremities, the second direction being perpendicular to the first direction; (c) embedding at least one pair of opposing extremities in respective opposing anchoring means; (d) providing mold means so that at least an intermediate portion of the first fiber means and an intermediate portion of the second fiber means are enclosed thereby; (e) tensioning at least one of the first fiber means and the second fiber means so as to give a pre-tension force thereto; and (f) molding concrete milk in the mold means so that the intermediate portions of the first fiber means and the second fiber means are embedded therein.

In a third aspect of the present invention, there is provided an apparatus for fabricating a pre-tension concrete member comprising: (a) mold means having a plurality of apertures for passing fiber means therethrough; (b) tensioning means for tensing the fiber means in a first direction so as to give the fiber means a pre-tension, the tensioning means being disposed outside the mold means on opposite sides thereof; and (c) holder means for holding the fiber means to be stretched in a second direction perpendicular to the first direction, the holder means being disposed outside the mold means on opposite sides thereof so as to be movable along the mold means.

Further objects and effects of the present invention will become clear from the following descriptions.

DETAILED DESCRIPTION OF THE PREFERRED EMBODIMENTS

Preferred embodiments of the present invention will now be described hereinafter with reference to the attached drawings. (Meshwork reinforced and pre-stressed concrete member)

Figure 1:
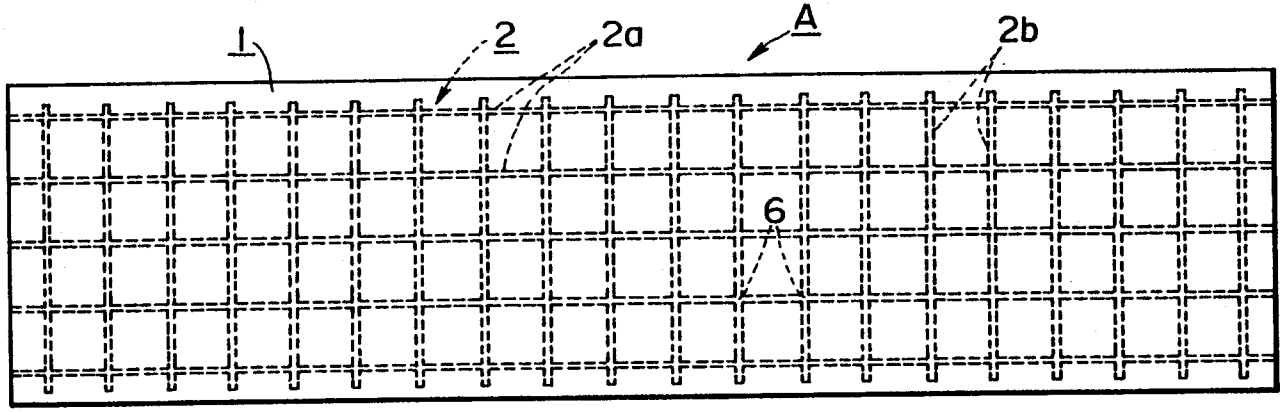
FIG. 1 shows a meshwork of reinforced and pre-stressed concrete member according to a preferred embodiment of the present invention.
Figure 2:
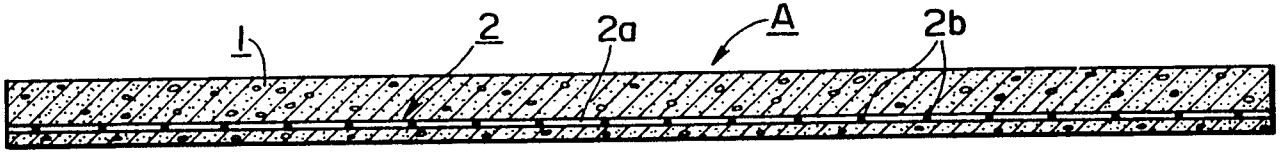
FIG. 2 is a cross sectional view of a concrete member shown in FIG. 1.
Figure 3:
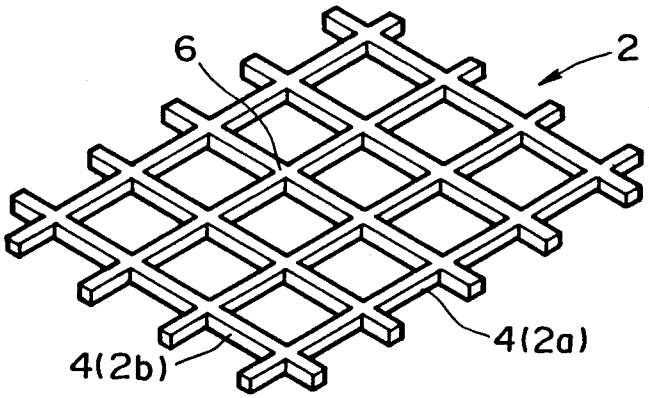
FIG. 3 shows a reinforcement member according to the present invention.
Figure 4:
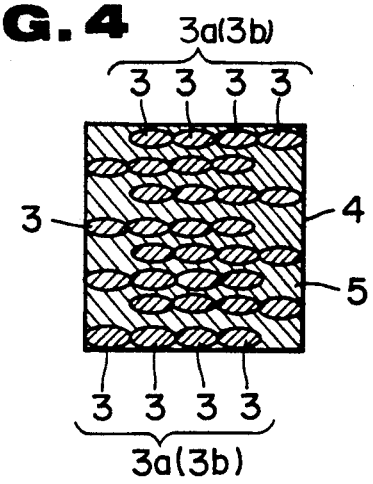
FIG. 4 shows a cross-section of a fiber bundle at a straight part of the reinforcement member.
Figure 5:
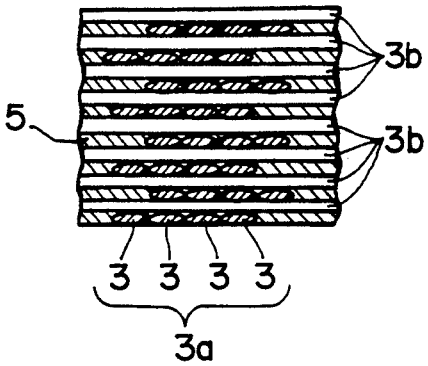
FIG. 5 shows a cross-section of a fiber bundle at an intersection of the reinforcement member.

FIGS. 1 through 5 show an embodiment of a meshwork reinforced and pre-stressed concrete member according to the present invention which may, for example, be used as a slab of a pedestrian overpass. As shown by the figures, the pre-stressed concrete member comprises a concrete body 1 and a reinforcement member 2 embedded in the concrete body 1. Further, longitudinal reinforcement elements 2*a* of the reinforcement member 2 are pre-tensioned, that is, the longitudinal reinforcement elements 2*a* and the concrete body are in contact to each other, and, due to a bonding force acting therebetween, the longitudinal reinforcement elements 2*a* are under a tensile stress and the concrete body 1 is under a compressive stress in the longitudinal direction wherein the longitudinal reinforcement elements 2*a* are extending. Dimensions of the concrete member is 200 cm×50 cm×10 cm in length, width and depth, for example. The reinforcement member 2 is laid closer to a lower surface of the concrete body than to an upper surface thereof in order to effectively resist against a moment forcing the member to deform convexly downward. reinforcement elements 2*a* and transverse reinforcement elements 2*b*, each of them composed of longitudinal and transverse fiber bundles 4, disposed parallel to and in a spaced relation to each other, comprising a plurality of fiber strands 3 bound together by a resin material, the fiber strands 3 comprising also a plurality of fibers stranded to each other. As shown in FIGS. 3 to 5, the longitudinal fiber bundles 4 are intersecting with the transverse fiber bundles 4 and form a grid or mesh pattern thereby. The intersecting fiber bundles 4 are bonded together by the resin material at their intersections. More precisely, fiber strands 3*a*, 3*b* are arranged in a row, and 8 rows are piled up to have a generally rectangular cross section, as shown in FIG. 4. At the intersections of the fiber bundles 4, as shown in FIG. 5, longitudinal rows of fiber strands 3*a* and transverse rows of fiber strands 3*b* are piled up alternately to intersect each other. Thickness of the reinforcement elements 2*a*, 2*b* is identical at any locations including the intersections. That is, the fiber strands 3 are flattened at the intersections as shown in FIG. 5. Surface of the reinforcement elements 2*a*, 2*b* is either smooth or roughened intentionally in order to increase the bonding force between the bundle 4 and the concrete body.

Carbon fibers, glass fibers and polyamide fibers, are preferable to be used to form the fiber strands 3. But the fiber material is not restricted to those ones, and synthetic resin fibers, ceramic fibers, and metallic fibers may be used. Fibers of different materials may be stranded to form a fiber strand 3, or strands 3, of different compositions may be used in a fiber bundle 4. Further, fiber bundles 4 of different compositions may be used in a reinforcement member 2.

Material for binding the fiber strands 3 may be selected from materials having enough strength in itself and a strong bonding force to the fiber strand 3. One example is a vinyl ester resin. But other materials such as nonsaturated polyester, epoxy resin, and phenor resin may be suitable to some kinds of the fiber strands 3.

Volumetric proportion of the fiber strands 3 and the binding material 5 in a bundle 4 is determined according to the nature of the materials such as strength thereof and mode of usage of the concrete member. For example, when glass fibers are used as the fiber strands 3 and vinyl ester resin is used as the binding material 5, volumetric proportion of the glass fiber strands had better be between 30% to 70%. When the fiber strands 3 are made of pitch carbon fibers, the proportion of the fiber strands 3 had better be between 20% to 60%. When the proportion of the fiber strands 3 is lower than the above mentioned value, strength of the concrete member becomes insufficient because of the insufficient tensile strength of the reinforcement member 2. On the contrary, when the proportion of the fiber strands is higher than the above mentioned value, there may not be a problem in strength, but the cost of the concrete member may be increased because of the increased cost of the fiber strands.

Experiments have shown that the maximum tensile strength of a fiber bundle composed of glass fibers, having a diameter of 23 um and occupying 38% by volume, bound by a vinyl ester resin, is 46.4 kg/mm$^2$ at a straight part. At an intersecting part, the strength is 20 kg/mm$^2$. When 20% by volume of carbon fibers are used, tensile strength at a straight part and at an intersecting part are 20.4 kg/mm$^2$ and 11 kg/mm$^2$, respectively.

Figures from 21 to 24 show a modified embodiment of the present invention.

Figure 21:
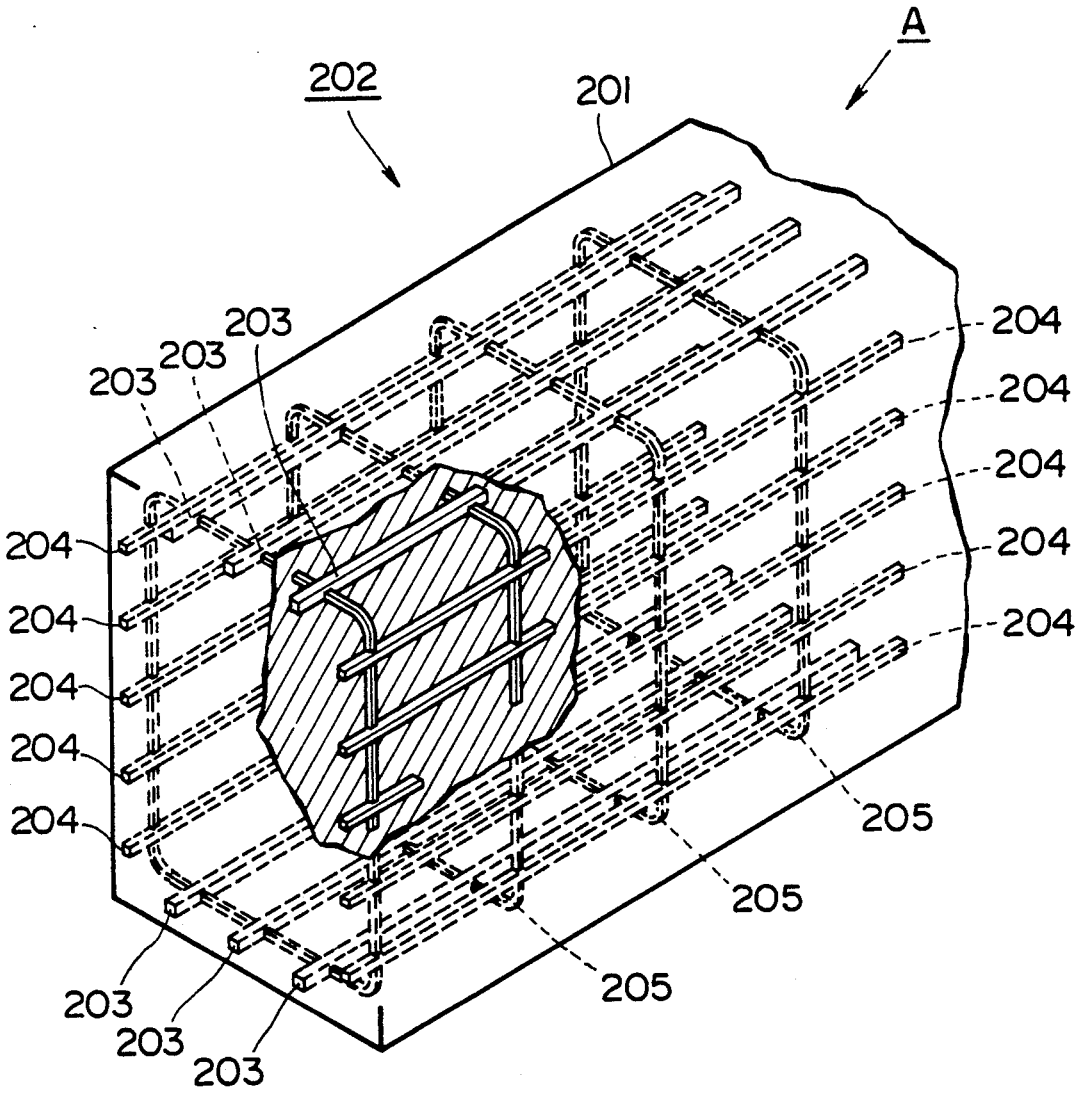
FIGS. 21 to 24 show a modified embodiment of the present invention.
Figure 22:
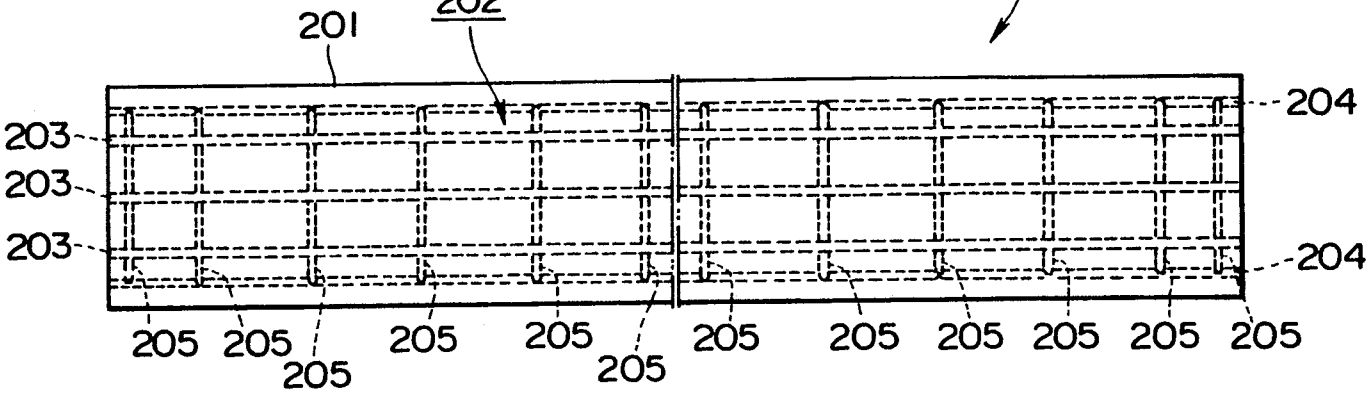
Figure 23:
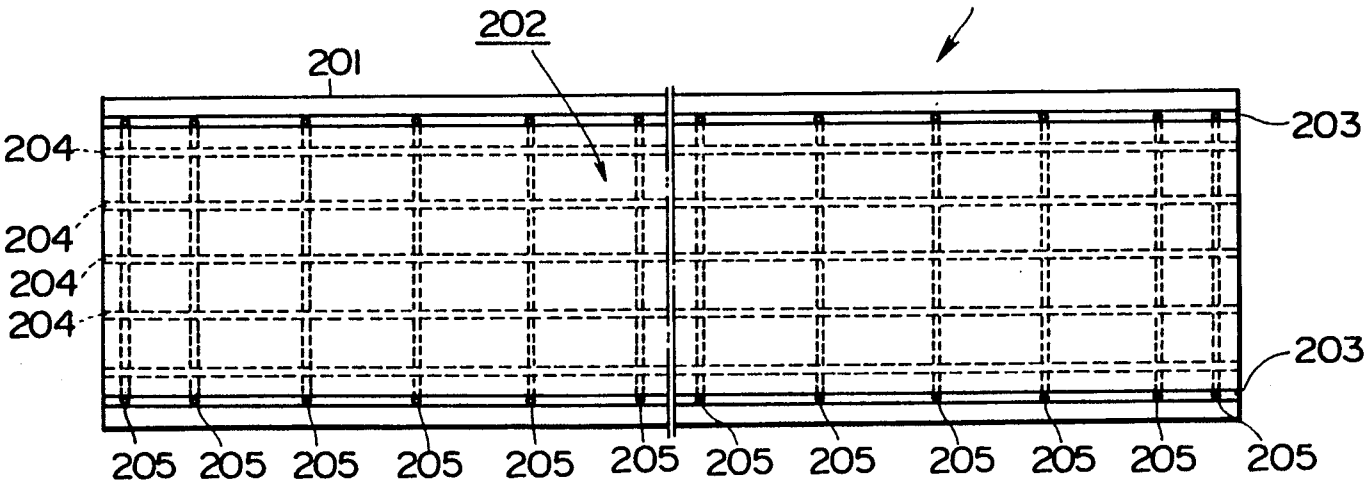
Figure 24:
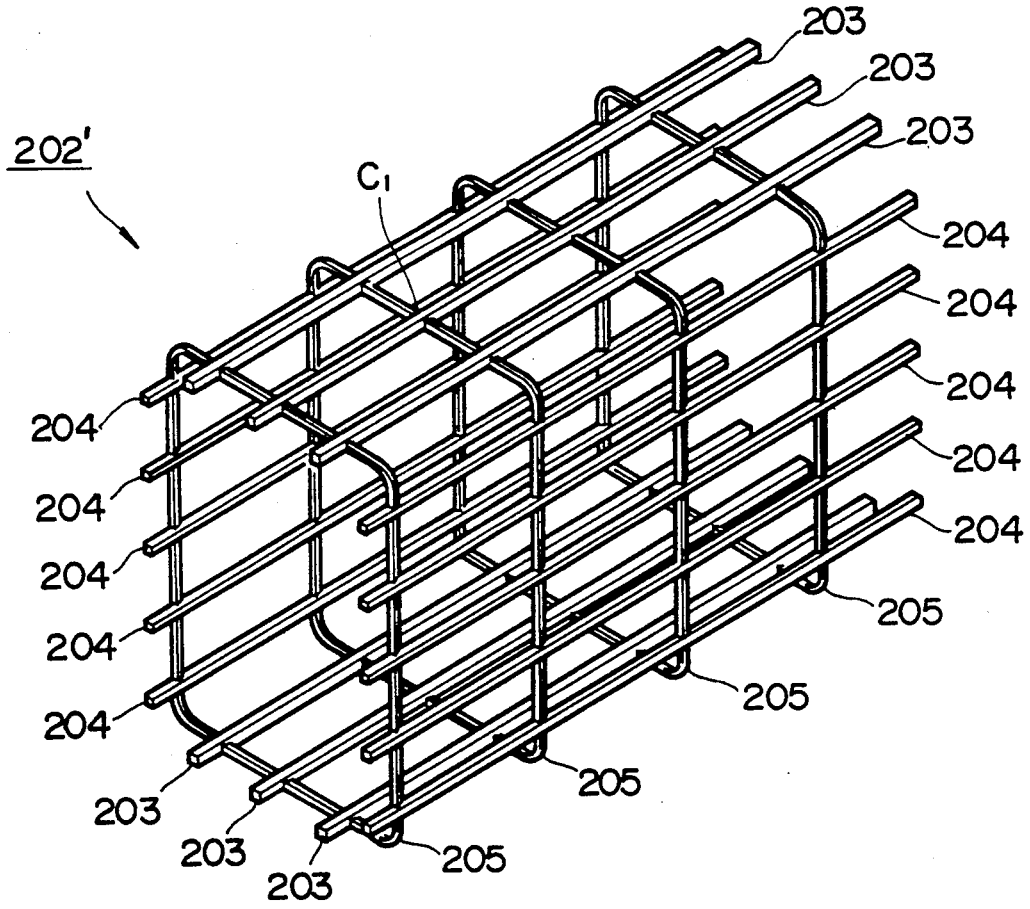

As shown in FIGS. 21 to 23, the pre-stressed concrete member 202 comprises a plurality of reinforcement members composed of longitudinal reinforcement side members 204, longitudinal reinforcement upper and lower members 203, and stirrup reinforcement members 205, all of which have the same construction as the above-mentioned embodiments, and a concrete body wherein the reinforcement members 203, 204, and 205 are embedded. The longitudinal reinforcement side members 204 and the longitudinal reinforcement upper and lower members 203 are arranged parallel to each other to have a distance between them and define a rectangular columnar space thereby. The stirrup reinforcement members 205 have a generally rectangular closed form and intersect the longitudinal members 203, 204 at a right angle. Construction of the intersections of the stirrup member 205 and the longitudinal members 203, 204, are the same as the intersections of the above-mentioned embodiments. At least one of the longitudinal members 203, 204 is pre-tensioned. Longitudinal members 203, 204 which will be tensioned when the concrete member is loaded are generally pre-tensioned. The magnitude of the pre-tension force is determined according to the moment or stress distribution in the concrete member and the strength of the reinforcement member. FIG. 22 is an elevation of a concrete member which is 100 cm×50 cm×30 cm in length×depth×width, respectively. FIG. 23 is a cross-section of the member. As shown in FIGS. 22 and 23, the longitudinal reinforcement members 203, 204 are disposed parallel to the longitudinal axis of the column A. The stirrup reinforcement members 205 are disposed in a plane perpendicular to the longitudinal axis of the reinforced concrete member A. FIG. 24 shows the reinforcement members 203, 204, 205 assembled together in a cage-like form so as to be disposed in concrete.

FIGS. 29 to 39 show further modified embodiments of the present invention.

Figure 29:
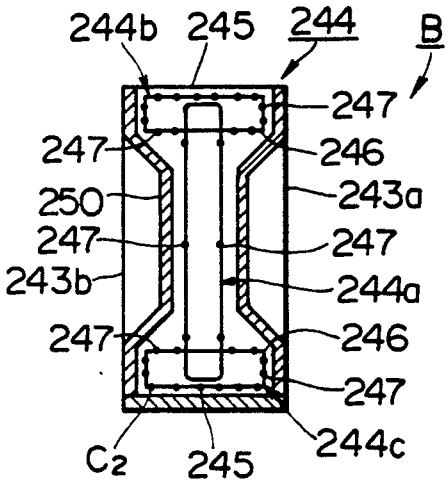
FIGS. 29 and 30 show a pre-stressed concrete beam member.
Figure 30:
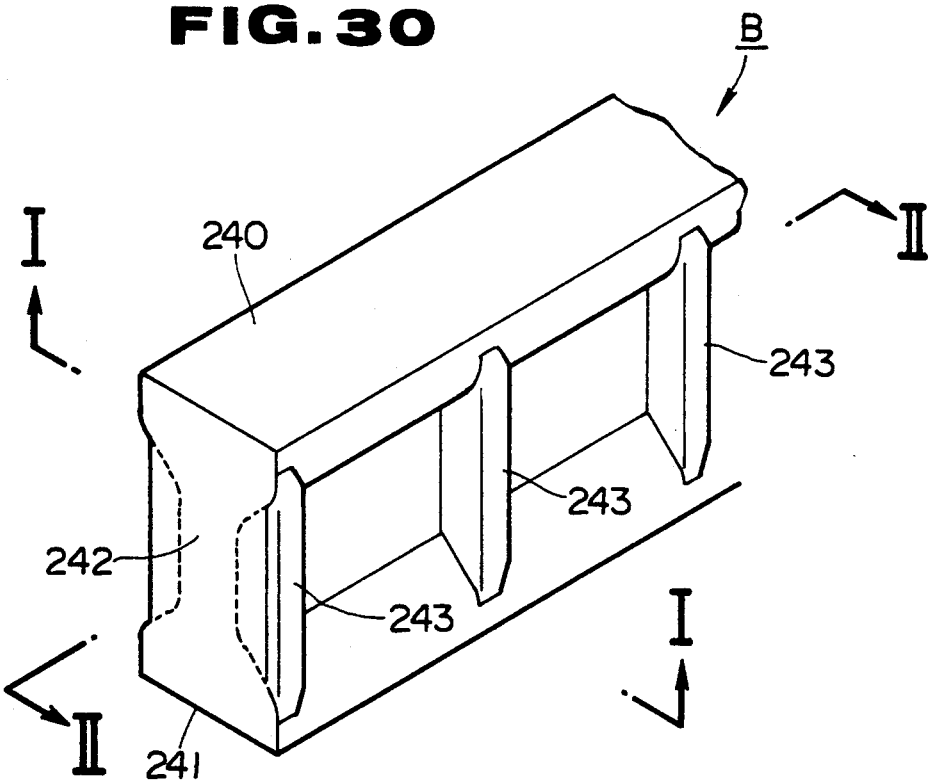

FIG. 29 and 30 show a pre-stressed concrete beam member comprising a web 242, a pair of flanges 240, 241 attached to the top and the bottom of the web along the longitudinal direction, and stiffeners 243 attached to the web 242 and the flanges 240, 241 perpendicular thereto. The concrete body embeds a web reinforcement member 247 and a pair of flange reinforcement members 247 C2. The web reinforcement member comprises six longitudinal reinforcement members 247, two of them disposed in the upper flange 240, two disposed at a mid part of the web 242, and two in the lower flange 241. Stirrup members 244*a* hold the six longitudinal reinforcement members 247. The flange reinforcement members C2 comprises a plurality of longitudinal reinforcement members 245, 247 embedded in the flanges 240, 241 and stirrup members 246 holding the longitudinal reinforcement members 245, 247. In this embodiment, the upper and the lower flange reinforcement member have an identical form and disposed symmetrically with respect to the plane of symmetry of the transverse cross-section of the beam B.

Figure 31:
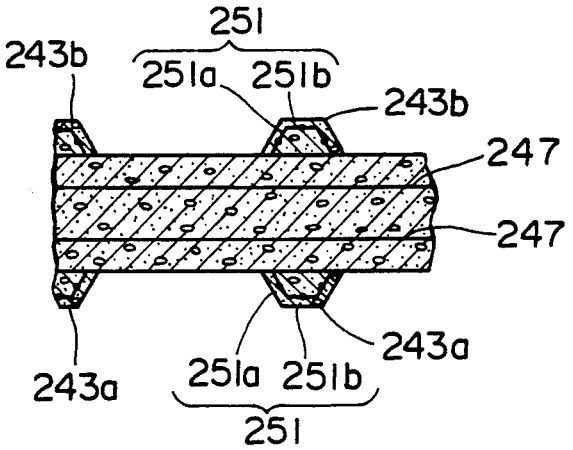
FIG. 31 shows a horizontal cross-section of the beam.
Figure 32:
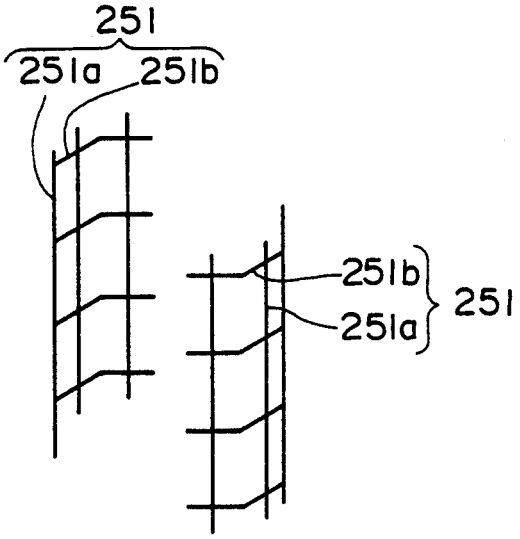
FIGS. 32 and 33 show a pair of stiffened reinforcement members.
Figure 33:
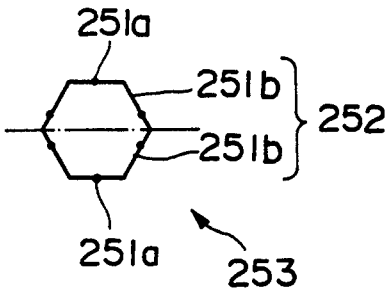

FIG. 31 shows a horizontal cross-section of the beam B. A stiffener 243, 243*a*, 243*b* embeds therein a stiffener reinforcement member 251 comprising vertical members 251*a* extending vertically parallel to each other and hoop members 251*b* disposed perpendicular to the vertical members 251*a* in a spaced relation to each other. A pair of stiffener reinforcement members 251 disposed symmetrically with respect to the plane of symmetry of the horizontal cross section of the beam B has a symmetrical form with respect to the same plane of symmetry. A pair of the stiffener reinforcement members 251 is fabricated by cutting into two a symmetric columnar cage-like structure composed of vertical members 251*a* and hoop members 251*b*, as shown FIGS. 32 and 33.

Figure 34:
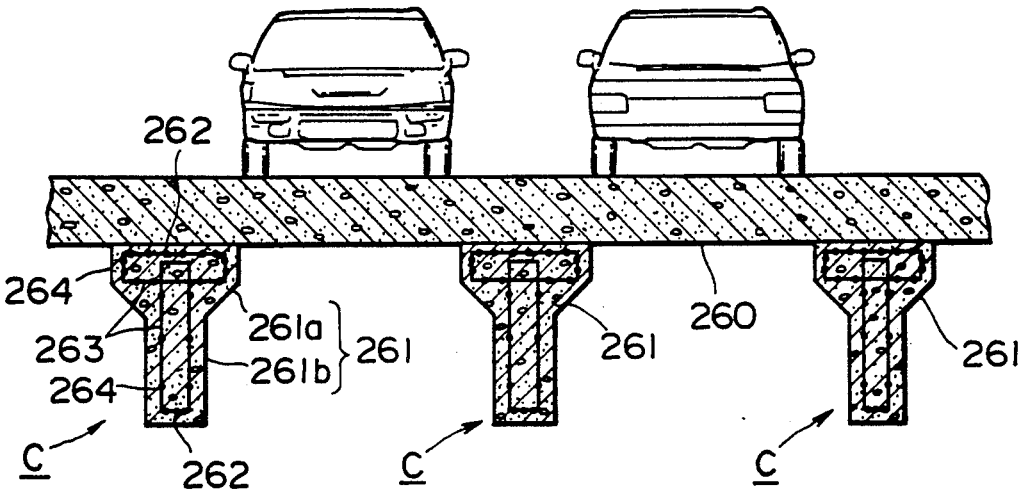
FIG. 34 shows another embodiment of the pre-stressed beams according to the present invention.

FIG. 34 shows another embodiment of the pre-stressed beam according to the present invention. The beams are so called T-beams having a cross-section generally in a T shape. At the flange 261*a* at a top of the cross-section, a flange reinforcement member comprising longitudinal reinforcement members 264 and stirrups 263 are disposed. At a web 261*b*, a web reinforcement member comprising longitudinal reinforcement members 262, 264 and stirrups 263 are disposed. By virtue of the light and strong nature of the reinforcement member and the strong intersection realized by, the present invention, the beam is slim and light in weight. The weather resistance of the member contributes also to a long service period of the member.

Figure 35:
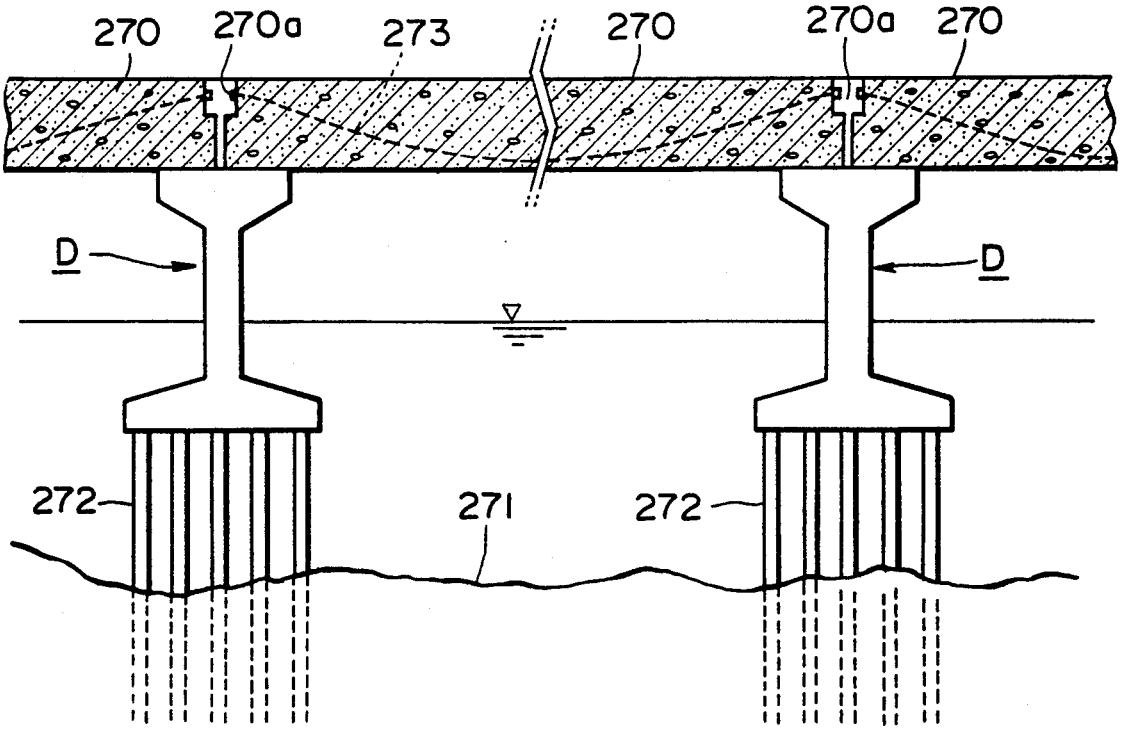
FIG. 35 shows another embodiment of the present invention.

FIG. 35 shows another embodiment of the present invention. In this embodiment, a pier structure D, half sunk in the sea, is supported by piles 272 driven in the ground 271. A meshwork reinforced and pre-stressed concrete plate 270 bridges two piers D and forms a platform on the sea. Because the pre-stressed concrete plate has the above-mentioned characteristics, the concrete plate is light weight and durable and is suitably used as a sea or off-shore structure. In this embodiment, a PC steel cable 273 which is hooked to hook means 270*a* at both ends is embedded in the plate. A post tension (which is a secondary pre-stress, more precisely) is given to the concrete plate 270 by tensioning the cable 273.

Figure 36:
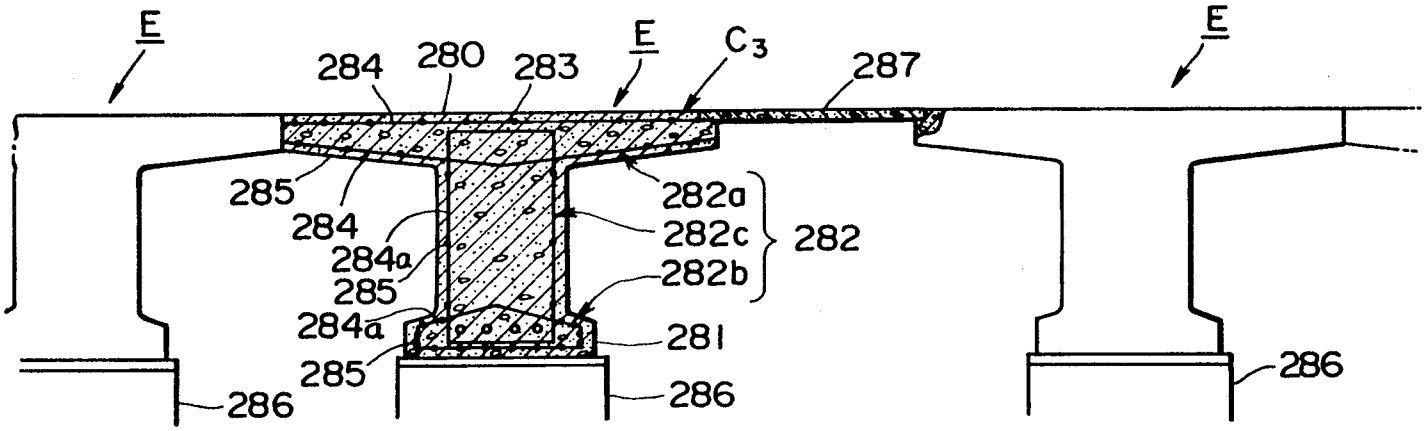
FIG. 36 shows a wing-like pre-tensioned concrete unit.

FIG. 36 show a wing-like pre-tension concrete unit which is used in an elevated highway structure, for example. The concrete unit has a wide spread upper flange 280 having flange reinforcement longitudinal members 283 and transverse members 284, a web having longitudinal reinforcement members 285 and stirrups 284*a*, and a footing 281 having longitudinal reinforcement members 285 and stirrup members 284*a*. The longitudinal reinforcement members 283, 285 are pre-stressed and the transverse members 284 of the upper flange also are pre-tensioned. The pre-tension of the longitudinal reinforcement member 283, 285 improves the resistance of the unit against a bending moment acting along the longitudinal axis of the unit. The pre-tension of the transverse reinforcement member 284 increase the strength of the wing-like projection of the upper flange against vertical loads. A plurality of the units E are disposed parallel in a distant relation to each other by a predetermined distance. A concrete plate, which may be a pre-stressed concrete plate, is disposed between the units E to cover the gap formed between them. The unit E is supported by a pier structure 286 which is supported from the ground.

Figure 39:
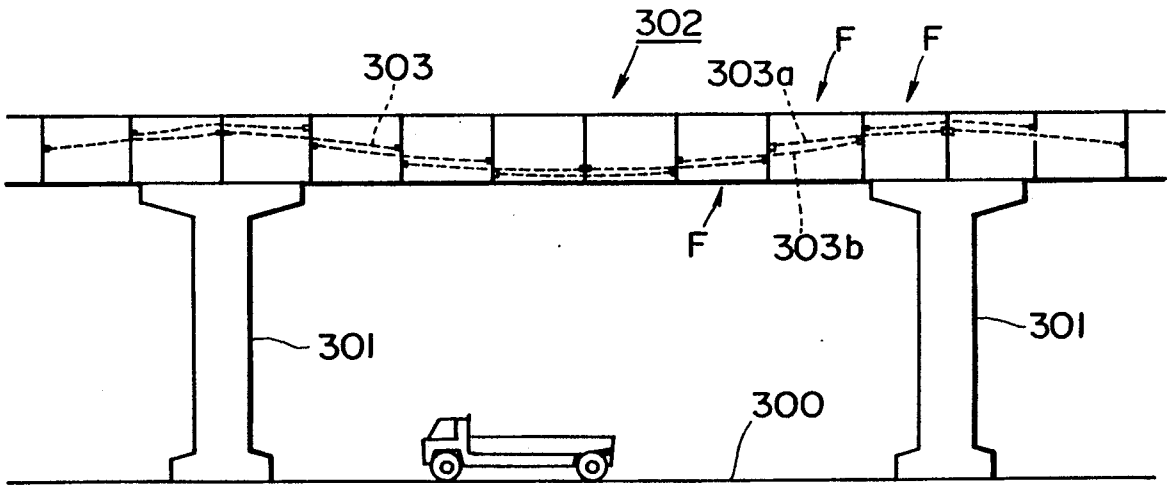
FIGS. 37 to 39 show an embodiment that is similar to the former embodiment but that is different in that the web part is replaced by a V-shaped structure having a box-like U-shaped cross-section.
Figure 37:
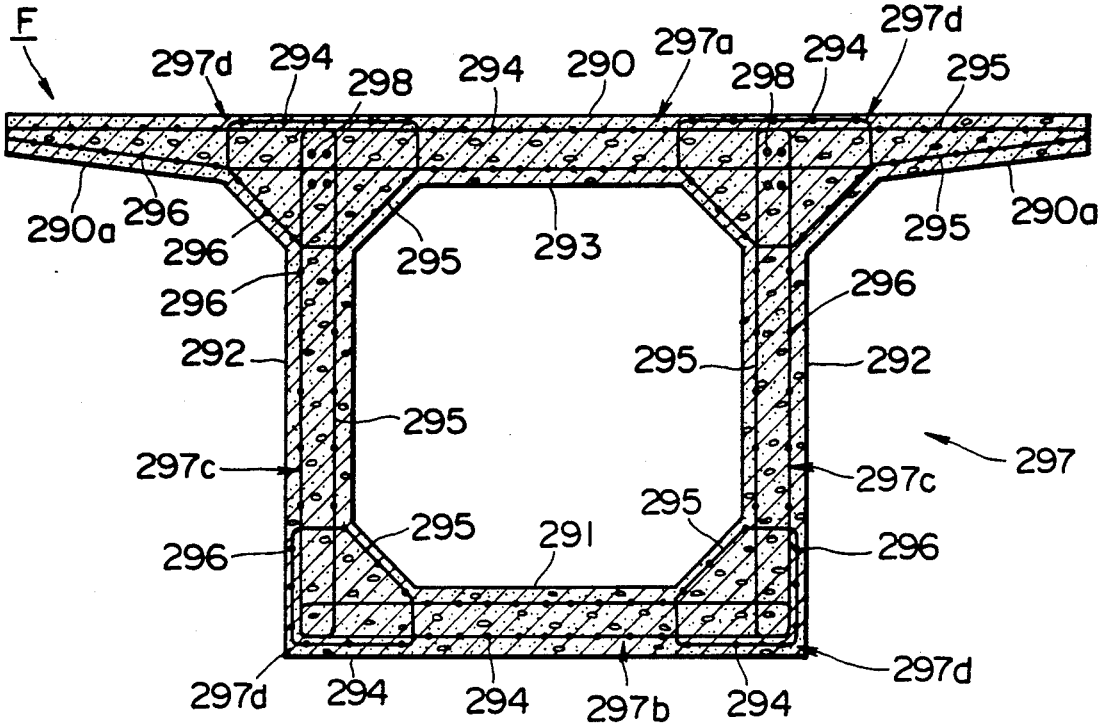
Figure 38:
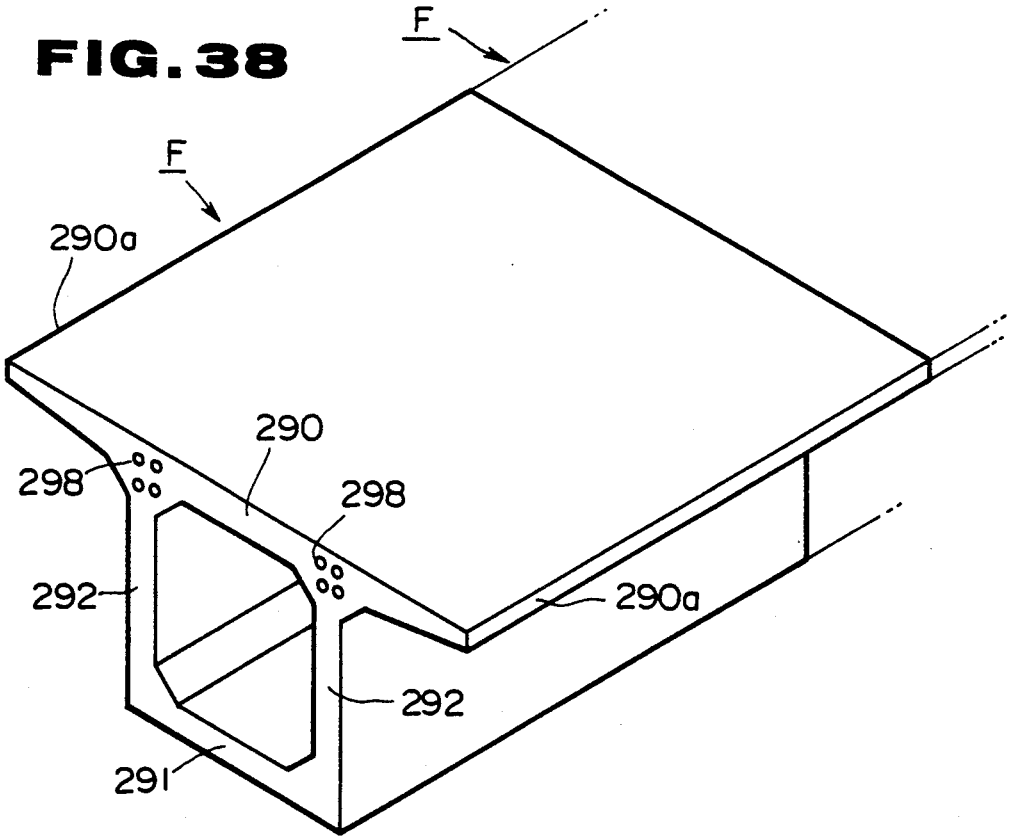

FIG. 37 to 39 shows an embodiment that is similar to the former embodiment but that is different in that the web part is replaced by a U-shaped structure 297 having a box-like U-shaped cross-section. The unit F has a top plate, 7 m×7 m in area for example, wherein longitudinal reinforcement members 294, 296 and transverse reinforcement members 295 are embedded. All of the reinforcement members 294, 295, 296 are pre-tensioned. Under the top plate, the U-shaped structure 297, having longitudinal reinforcement members 294, 294, 296 and transverse reinforcement members 295, 297*b*, 297*c* being embedded, is attached. The junctions of the top plate 290 and the upper part of the U-shaped structure 297 and the corners 297*d* at the bottom of the U-shaped structure 297 are further strengthened by means of a corner reinforcement members which also comprises longitudinal members and transverse members. Reinforcement members embedded in the top plate, in the side walls of the U-shaped 297 structure, in the bottom plate of the U-shaped structure 297 and in the corners thereof have a cage-like structure constructed as above-mentioned. By virtue of the two-dimensional pre-tension and unitary construction of the reinforcement structure, the pre-stressed concrete unit F has an improved strength against a longitudinal bending and vertical loads acting on the flange portions. The unit may be connected in series to form a track for a train or linear motor car which passes thereon. The hollow space defined by the top plate 290 and the U-shaped structure 297 may provide a space for cables of various kind, for example.

Sheathes for receiving a post-tension cable 298 are disposed longitudinally in the unit F. As shown in FIG. 39, position of the post-tension cables are different from one unit to another. When constructing a track by the concrete unit F, concrete columns 301 are constructed from the ground first. Then, units are posed and attached on the column 301. Track is extended from the unit attached to the columns 301 one by one. While extending the track, a post tension cable 303 is inserted in the sheath 298 and a post-tension is given to the cable 303. Post-tension cables 303 of adjacent concrete units are connected to each other, then one proceeds to an extension of the track. Position of the post-tension cables 303 is determined so that the cables 303 resist tensile force cause by a bending moment most effectively. Therefore, in the example, post-tension cables 303 are disposed at a higher position in the units near the concrete column 301, and at a lower position in the units at a midst of two columns.

By virtue of the above-mentioned construction, the pre-stressed concrete member according to the present invention has a high strength during a long service period. Further, the concrete member is corrosion resistant due to a corrosion resistant nature of the material used for the reinforcement member. Because of the pre-stress, cracking of the concrete member is suppressed. Further, because the above-mentioned fiber strands are more flexible compared to the metallic reinforcements, once a pre-stress is given thereto, the pre-stress is stable against shrinkage or creep of the concrete.

METHOD FOR FABRICATING THE CONCRETE MEMBER

Method for fabricating the above-mentioned concrete member will be explained next.

Figure 6:
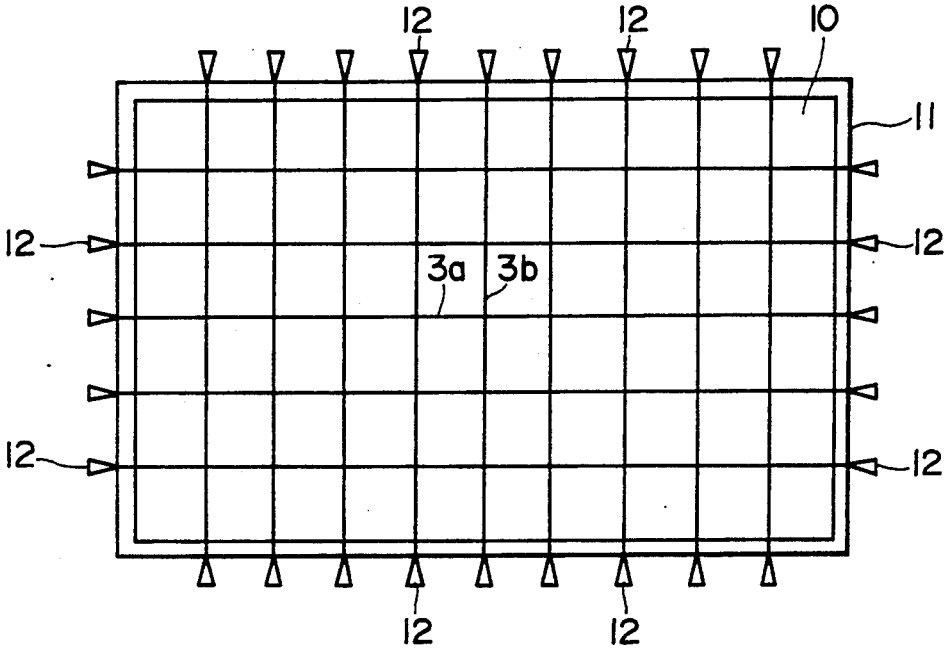
FIG. 6 shows an apparatus with which the reinforcement member is fabricated.
Figure 7:
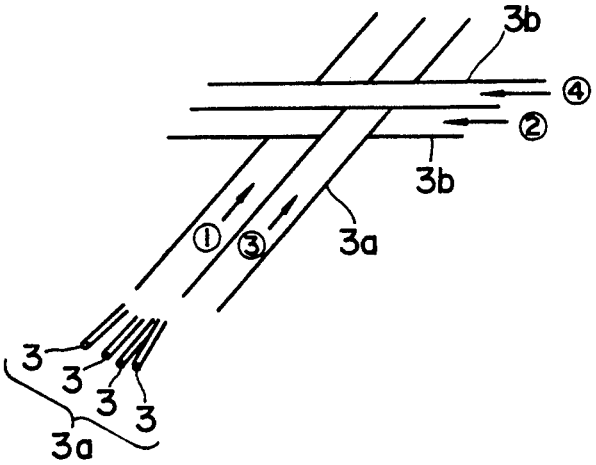
FIG. 7 shows how fiber strands are knitted at the intersection of the reinforcement member.

First, fabrication of a meshwork-like reinforcement member is described with reference to FIG. 6. Guide frames 11 is disposed on a base 10 so as to define a rectangular region therein on the base 10. Pins 12 are disposed on the base 10 to which the longitudinal and transverse fiber strands 3 are to be hooked. An elongated fiber strand 3 is stretched between the pins 12 so that the fiber strand 3 threads the pins 12 successively one to the other to form a grid-like form in the frames 11. The lowest row of the longitudinal fiber strands 3 are stretched first. Then, the lowest row of the transverse fiber strands are stretched intersecting the longitudinal fiber elements. Next, the second row of the longitudinal fiber strands 3 are stretched on the first transverse row. Thus the fiber strands 3 are stretched continuously, and the grid-like form is formed from the lowest row to the upper rows gradually up to the third layer from bottom at least. FIG. 7 shows schematically how the longitudinal and the transverse rows are laid one to the other at an intersection. As shown in the figure, four fiber strands 3 composing a row are stretched parallel to each other and come in contact with another four fiber strands 3 to intersect the latter at a right angle. Thus the rows are laid by turns so that longitudinal fiber strands 3 are sandwiched by transverse fiber strands 3 and vice versa. The intersection comprises 8 longitudinal layers and as many transverse layers laid by turns. Stretching of the fiber strands 3 may be performed by hand. But, it is desirable that the stretching is performed by an apparatus wherein a program for an automatic movement is implanted.

Figure 8:
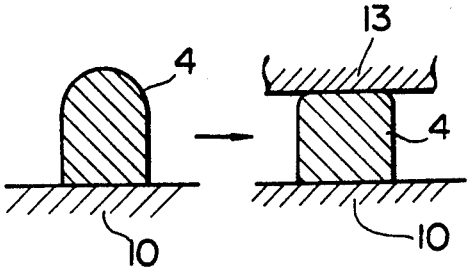
FIG. 8 shows how the cross-section of the reinforcement member is regulated.

After the fiber strands 3 are stretched and laid as mentioned above, form of bundles of fiber strands, that is the reinforcement member 2, is regulated by means of a plate 13 as shown in FIG. 8 by sandwiching the reinforcement member 2 between the plate 13 and the base 10. When the surface of the plate 13 and the base 10 is flat as shown in the figure, a reinforcement member 2 having a flat surface is obtained. The surface of the plate 13 and the base 10 may be roughened so as to form a rough surface on the reinforce member 2. Roughened surface of the reinforcement member 2 increases a bonding strength against concrete and further improves the performance of the thus obtained reinforced concrete member.

In the above description, reinforcement member is supposed to have a flat form having a equidistantly spaced fiber bundles, for a simplicity of the description. But, the form is not restricted to be flat, and the fiber bundles may be spaced with any arbitrary distance. On the contrary, distance of the fiber bundles may preferably be changed according to a stress condition of the concrete member. The reinforcement member may also be extending 3-dimensionally. In a 3-dimensional reinforcement member, longitudinal reinforcement members are stretched to define a columnar space, and transverse reinforcement members are laid to bind the longitudinal reinforcement members from outside. The 3-dimensional reinforcement member will suitably be used in pre-stressed concrete beams and columns, for example. In this embodiment, transverse fiber bundles may be either in a closed form, circular, or rectangular according to the disposition of the longitudinal reinforcement members, intersecting perpendicularly each longitudinal fiber bundle at each intersection or wound spiral around the longitudinal reinforced members bundles so as to intersect them at an acute angle at each intersection.

Second, anchor means for holding the fiber bundles are fabricated as follows.

Figure 9:
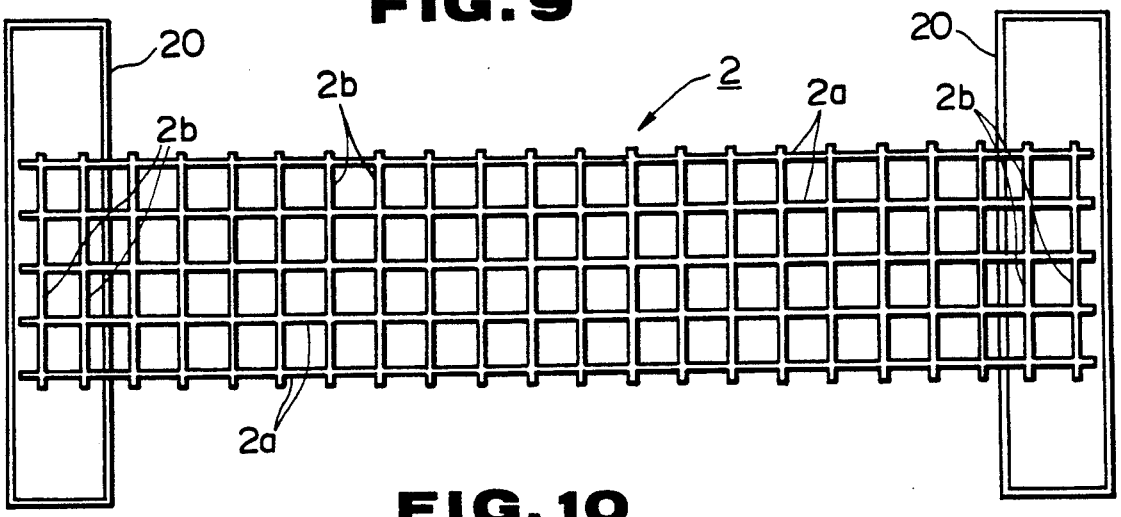
FIG. 9 to 11 show procedures for fabricating a meshwork reinforced and pre-stressed concrete member according to an embodiment of the present invention.

After stretching the fiber strands 3 and forming the reinforcement member 2, a mold 20 for molding an anchoring block 21 is assembled so as to enclose each of the extremities of the fiber bundles to which a pre-stress is to be given, as shown in FIG. 9. Then, concrete or milk or a raw or resin material is poured in the mold 20. When the concrete or the raw resin is solidified, an the anchoring block 21 is obtained. In FIG. 9, anchoring block 21 is formed at each of the extremities of the longitudinal fiber bundles so as to embed the extremity therein.

Third, pre-stress is give to the reinforcement member 2 according to the following procedure.

Figure 10:
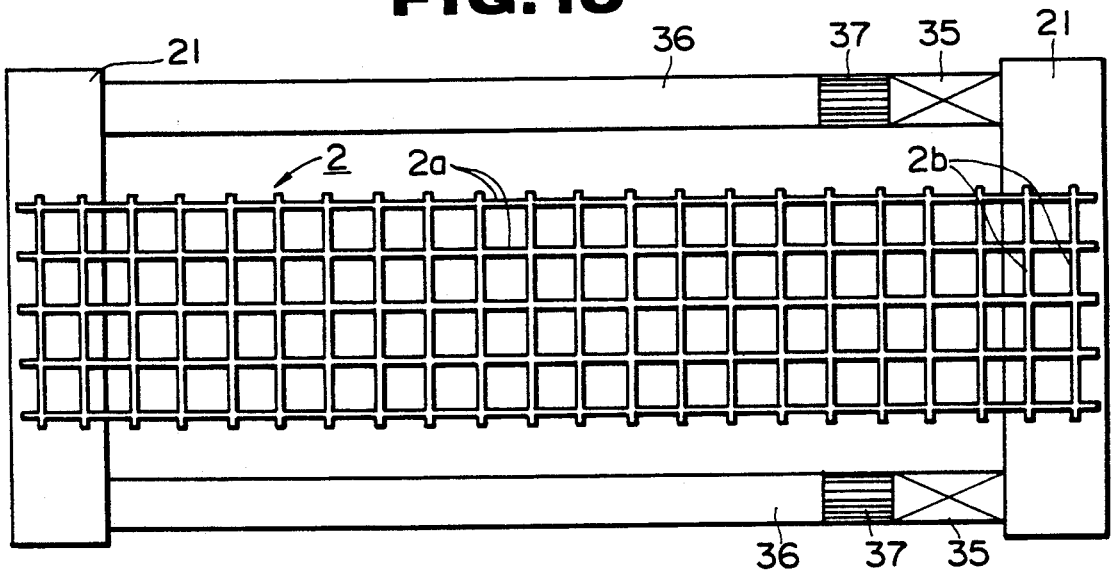
Figure 11:
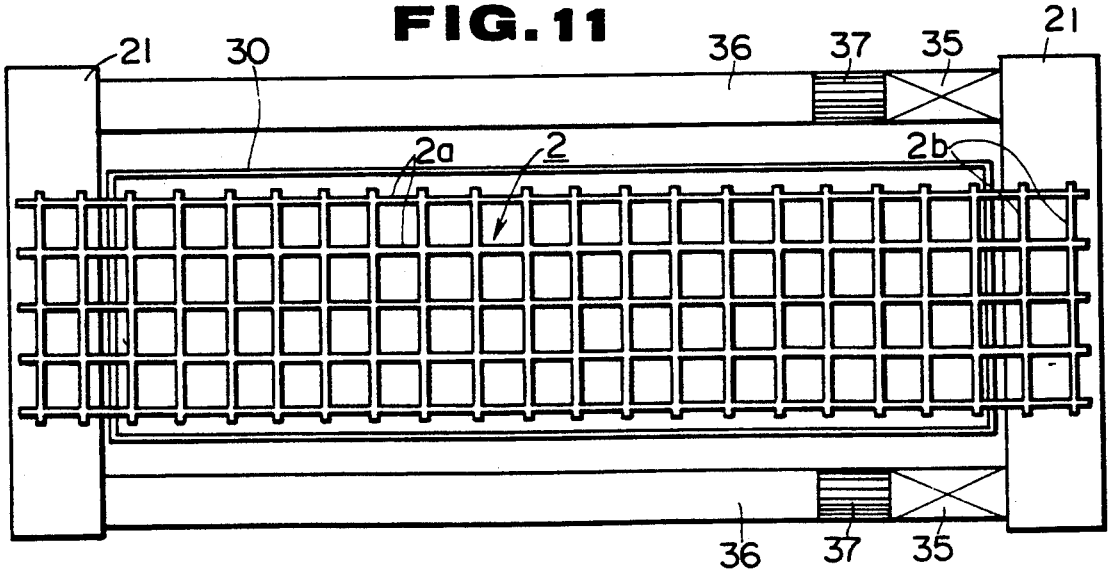

A mold 30 for molding a pre-stressed concrete member is assembled on the base 10 so that an intermediate portion of the reinforcement member 2 is enclosed thereby, and the extremities of the fiber bundles 4 to which a pre-stress is to be given is located out of the mold 30 together with the anchoring blocks 21, as shown in FIGS. 10 and 11. The fiber bundles pass through the mold 30. Opposing pairs of distal portions of the anchoring blocks 21 are connected by a column 36, a load cell 37, and a jack 35 connected in series. When the jacks 35 are activated, the jacks 35 push the anchoring blocks 21 apart from each other, receiving a reaction force therefrom so as to give a pre-tension force to the longitudinal reinforcement elements 2*a*. Subsequently, concrete milk is poured in the mold 30 to keep the pre-tension force acting on the reinforcement member 2.

After the concrete is solidified, the load of the jacks 35 is relieved, and the jacks 35 are dismantled together with the column 36 and the load cell 37. Then the mold 30 is dismantled from the solidified concrete member, and a portion of the reinforcement member 2 extruding out of the concrete member is cut off. Thus a pre-stressed reinforced concrete member according to the present invention is obtained. The extruding portion of the reinforcement member may be cut off before the mold 30 is dismantled.

Thus obtained pre-stressed reinforced concrete member has following characteristics and strong points.

Intersection 6 of the reinforcement member 2 is strong by virtue of the multi layered fiber bundles 4 and the binding material binding the bundles 4 together. Therefor, the concrete member has an improved strength due to its increased bond strength between the reinforcement member 2 and the concrete body 1. In the concrete member fabricated according to the above-mentioned method, mechanical anchoring between the reinforcement member 2 and the concrete body 1 at the intersections 6 strengthens the bond force which has been conventionally born only by the bonding force of the reinforcement bars. Consequently, tensile force acting in the reinforcement members 2 is transmitted effectively to the concrete body 1, and the reinforcement member 2 and the concrete body 1 act as a unitary structure. Further, the structure does not require a special means for bonding the reinforcement structure 2 with the concrete body 1, unlike the FRP post-tension concrete members, which largely simplifies the work and the instruments needed for its fabrication.

Figure 12:
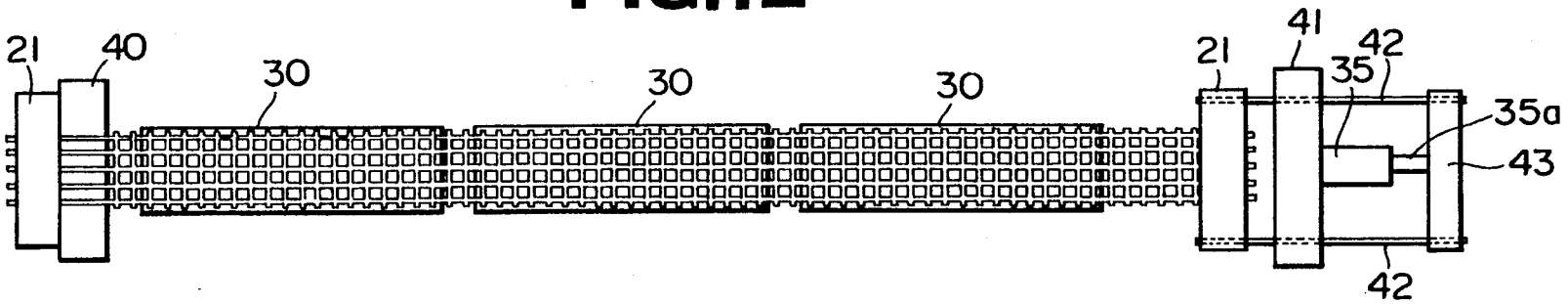
FIG. 12 shows an embodiment of a method for fabricating a plurality of concrete members at a same time.

FIG. 12 shows another embodiment of the method according to the present invention.

The method enables a fabrication of plural reinforced concrete members or panels at a the same time. Molds 30 for reinforcement members are arranged in a row so that the axes thereof, along which the pre-stressed fiber bundles are extending, are aligned straight. An anchoring block 21 is disposed so that each of the extremities of the longitudinal reinforcement members 2 passing through the molds 30 are anchored therein. A pair of reaction blocks 40, 41 are disposed apart along the line of alignment so as to have the molds 30 therebetween. The longitudinal fiber bundles 4 are passed through the molds 30 between the two anchoring blocks 21. Each anchoring block 21 is located so that a surface thereof, from which the reinforcement members 2 are extending, comes in contact with a reaction block 40. Another anchoring block 21, on the right side in FIG. 12, is connected with a receiver member 43, disposed outside of the reaction block 41, by a pair of tension rods 42 passing through holes formed through the reaction block 41. A jack 35 is attached to the reaction block 41 and connected to the receiver member 43 by a jack rod 35*a*. A pre-tension force is applied to the longitudinal reinforcement member by extending the jack 35 so as to push the receiver member 43 apart from the reaction block 41. The tension rods 42 pull the anchoring block 21, apart from the other anchoring block 21, and a pre-tension force is given to the reinforcement member.

After the above procedures, concrete milk is poured in the mold 30, and reinforcement members extruding out of the mold 30 are cut off to cut apart the pre-stressed members.

Figure 14:
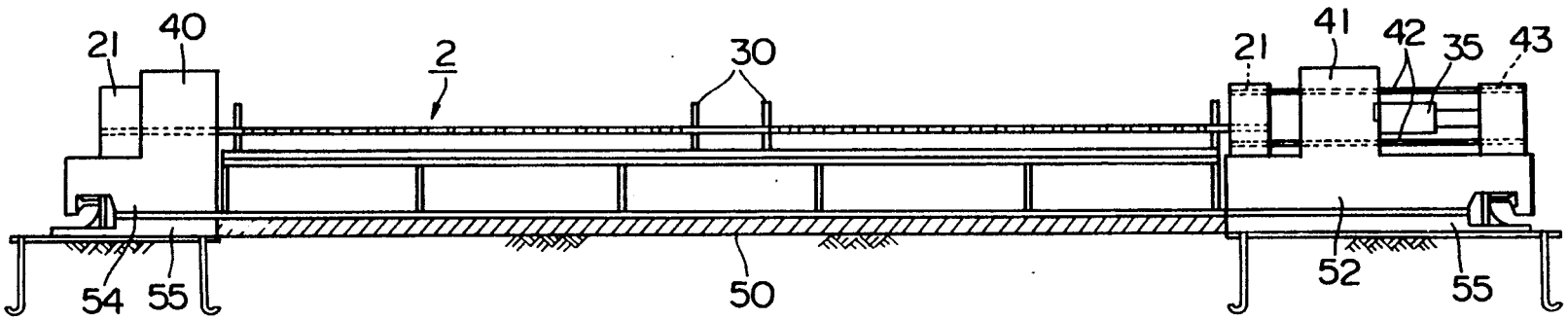
FIG. 14 shows a cross-sectional view of an apparatus for fabricating a concrete member.
Figure 13:
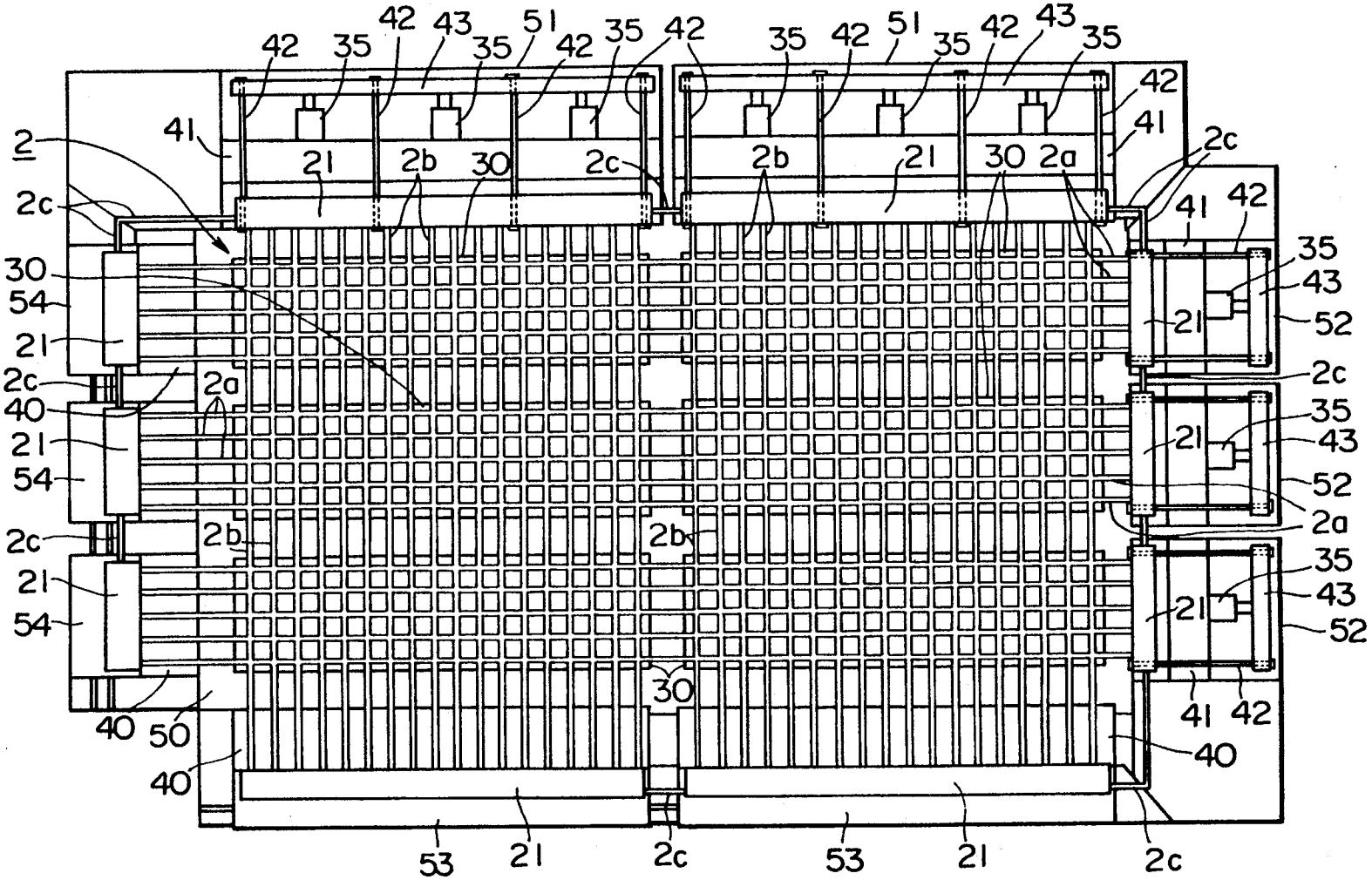
FIG. 13 shows another embodiment for fabricating a plurality of concrete members.

FIGS. 13 and 14 show another embodiment of the present invention wherein a pre-tension is given to both longitudinal and transverse reinforcement members. According to the figure, numeral 50 denotes a base on which a a mold for molding a pre-stressed concrete member is mounted. Jacks 35 are attached to jack holders 51, 52. Reaction holders 53, 54 are connected to a reaction block 21. Six molds are arranged on the base 50. Guide rails 55 are attached to the mold for supporting the jack holders 51, 52 and the reaction holders 53, 54. The jack holders 51, 52 and the reaction holders 53, 54 are movable along the guide rails 55. A reaction block 41, through which tension rods 42 pass, is disposed in the vicinity of the jack holders 51, 52. A reaction block 40 is located near the anchoring block 21 so as to fix it thereon. As shown by the figure, two jack holders 51 are disposed along the longitudinal direction, from the left to the right direction in the figure, each jack holder mounting three jacks 35 thereon. Three jack holders 52 are disposed along a transverse direction of the guide rail 55, each jack holder mounting a jack 35 thereon. The jacks 35 mounted on the jack holders 51 and 52 tension the reinforcement members in the longitudinal direction and the transverse direction, respectively. The anchoring blocks 21 are tied together for a movement along the guide rail 55.

When the jacks 35 mounted on the jack holders 51 tension the reinforcement member in transverse direction, the reinforcement member is extended and the intersections dislocate in that direction. Consequently, the reaction holders slides in the transverse direction, and the longitudinal reinforcement members are kept perpendicular to each other always. Because the jack holders 51, 52 are connected to each other by the tie rods, movement thereof coincide to each other. When the jacks 35 mounted on the reaction holders 52 tensions the reinforcement member in the longitudinal direction, the jack holders 51 moves in the longitudinal direction according to a movement of the intersections.

Experimental results show that, for a reinforcement member having 40% by volume of glass fiber and 60% by volume of vinyl ester and 1 $cm^2$ of cross section area of each reinforcement bar, the strain was 0.4% for a 1,000 kg of tensile force acting on a reinforcement bar.

Followings are the methods by which reinforced concrete members are fabricated.

First, the anchoring blocks 21 are mounted on the base, the mold 30 is assembled on the base 50, and the reinforcement member 2 is extended on the base 50 passing through the mold 30 and so as to be anchored by the anchoring blocks 21 at the extremities. The jack holders 51, 52 and the reaction holders 53, 54 are installed in place. Jacks 35 having respective jack rods 36, are installed. Then, the jack rods 35*a* are extended to tension the reinforcement member.

Second, while keeping the tension acting in the reinforcement member 2, concrete milk is poured in the mold 30. The concrete is cured till it is solidified. Then, after the concrete is solidified, the jacks 35 are relieved from the tension and dismantled from the jack holders 51, 52 and the reaction holders 53, 54. The reinforcement member 2 extruding from the concrete member is cut off the member. Thus, a pre-stressed concrete member or a bi-directionally pre-tensioned concrete plate is obtained.

Figure 15:
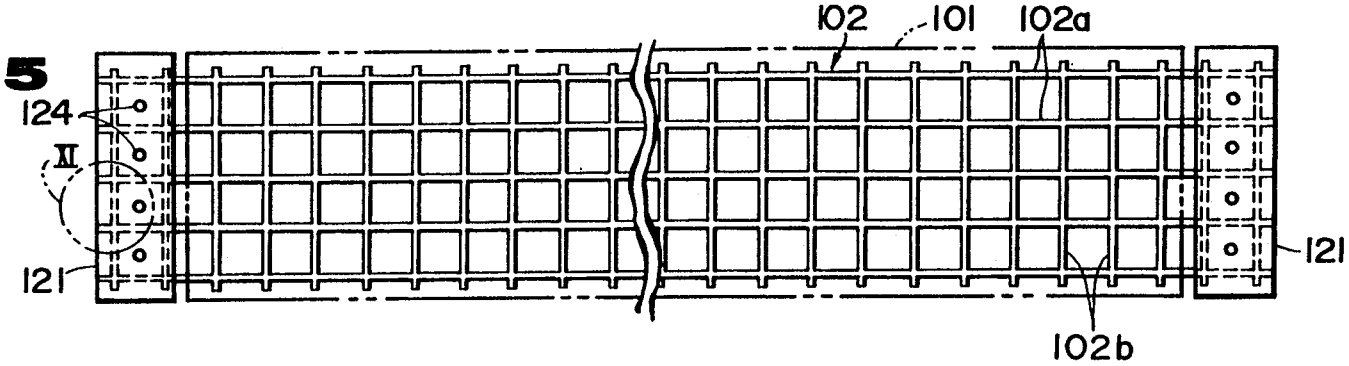
FIGS. 15 to 17 show another embodiment for fabricating the anchoring means.
Figure 16:
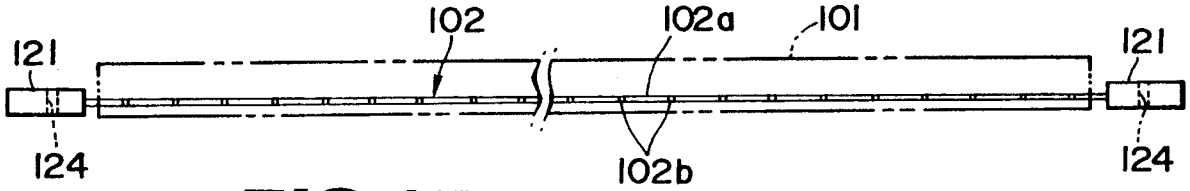
Figure 17:
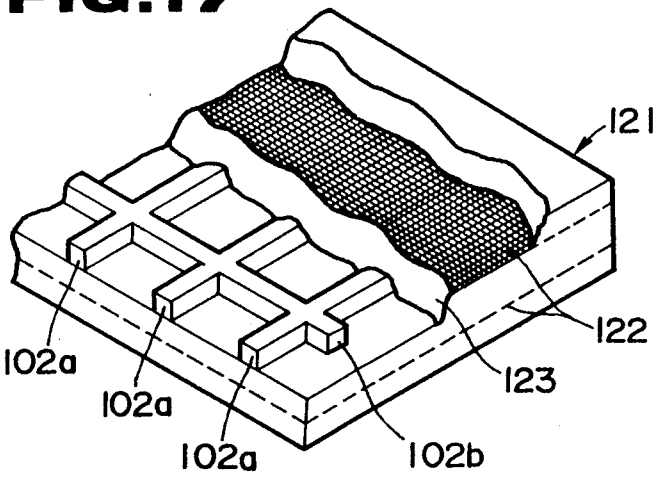

FIGS. 15 to 17 show another embodiment for fabricating the anchoring means.

Distal portions of the reinforcement member 102 is enclosed by respective molds which covers a few transverse reinforcement member 102*b* together with distal portions of longitudinal reinforcement members 102*a*. A pair of fiber reinforced plastic anchoring means 121 are formed in the respective molds. The anchoring means 121 comprises a pair of fiber mesh 122 disposed on both side of the reinforcement member 102 and resin material 123 embedding the reinforcement member 102 and the fiber meshes 122, FIG. 17. A through-hole 124 passing through the thickness of the anchoring means 121 is formed at each rectangular portion defined by the grid of reinforcement member. Resistance against a force pulling the reinforcement member 102 out of the anchoring means 121 is obtained mainly by virtue of the mechanical anchoring of the intersections in the resin material. Therefor, by determining suitable number of transverse reinforcement members 102*b*, desirable strength of the anchoring means is obtained.

Figure 18:
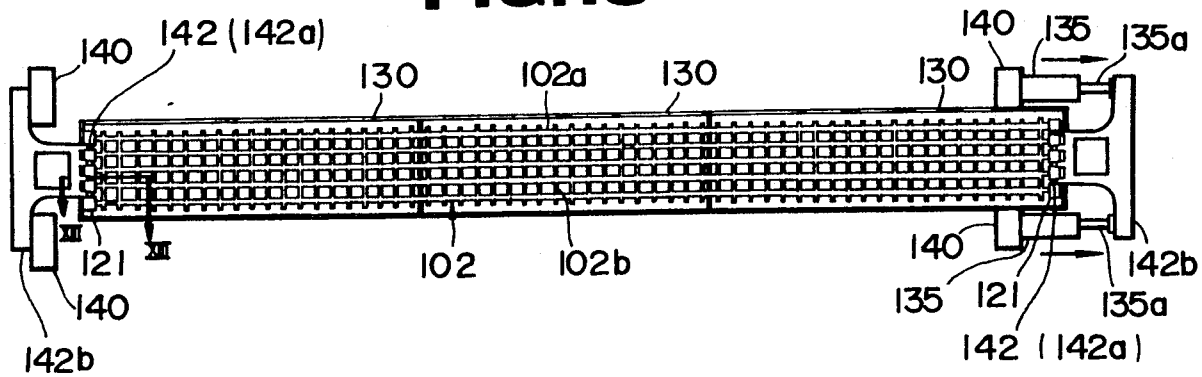
FIGS. 18 and 19 show another embodiment for giving a pre-stress to the concrete member.
Figure 19:
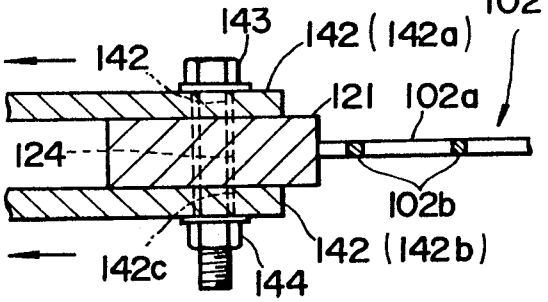

Another embodiment for giving a pre-stress to the concrete member is shown in FIGS. 18 and 19.

A plurality of molds 130 for molding concrete members are assembled to cover the greater part of the reinforcement member 102. An anchoring means 121 is connected to a fixation member 142 which is fixed at a pair of reaction abutments 140 connected to the base for obtaining a reaction force when the reinforcement member 102 is tensioned. Connection of the anchoring means 121 to the fixation member 142 is performed as follows. The anchoring means 121 is inserted into the arms 142*b* of the fixation member 142 so that through-holes 142*c* formed through the respective arms 142*b* come to a coaxial position with respect to the through-holes 124 of the anchoring means 121. Then, a bolt 143 is inserted to pass through the through holes 142*c*, 124 and a nut 144 is screwed from the distal end of the bolt 143 to hold tightly the fixation member 142*a* and the anchoring means 121. Another fixation member 142 is attached to the anchoring means 121 connected to the other end of the reinforcement member 102. A pair of jacks 135 supported from the reaction abutments 140 are attached to the fixation member 142. By pushing the fixation member 142 by virtue of the jacks 135 apart from the other end, a pre-stress force is exerted on the reinforcement member 102.

Figure 20:
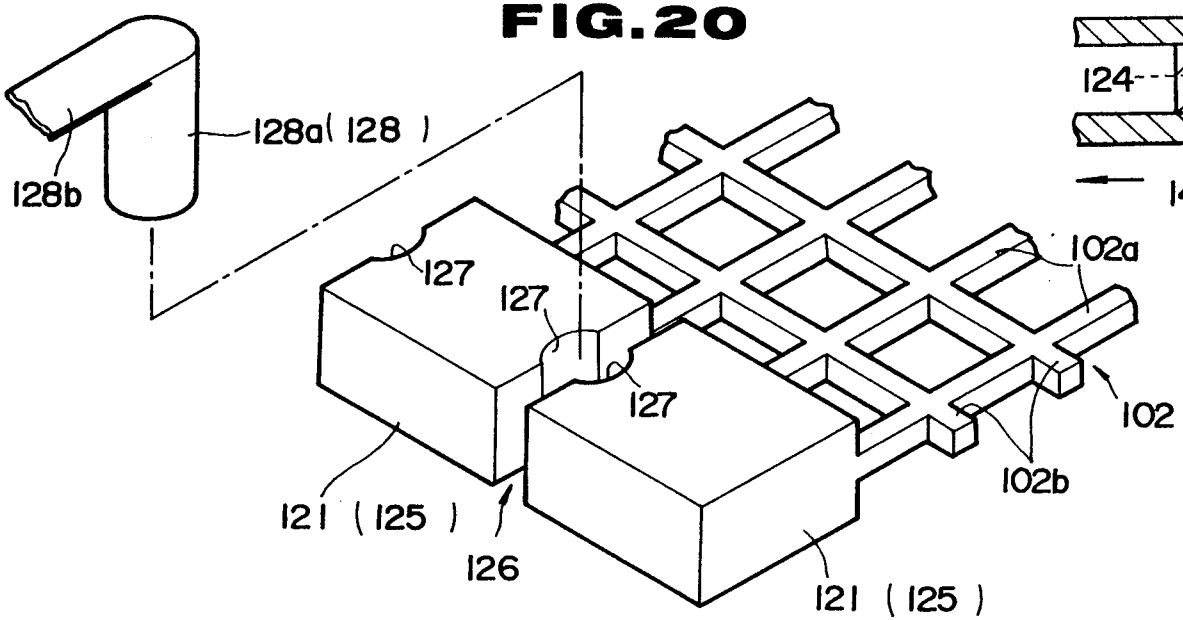
FIG. 20 shows a modified embodiment of the anchoring means.

FIG. 20 shows a modified embodiment of the anchoring means. In this embodiment, the anchoring means 121 is composed of a plurality of anchoring blocks 125 which are connected to the extremities of the longitudinal reinforcement members 102*a*. A slit 126 is formed between the blocks 125. At a mid-part of the surface opposing to each other over the slit 126, a concavity 127 is formed therein. The concavities 127 defines a circular cylindrical space thereby. This anchoring means 121 engages with a hook means 128 having cylindrical bolt portion 128*a* which is to be inserted through the cylindrical space and an extension member 128*b* connecting the bolt portion to a hook body (not shown).

Holding mechanism to connect the anchoring means to the fixation means is not restricted to the above-mentioned construction, but any other mechanisms may be employed so long as the mechanism is capable of withstanding the pre-tension force. For example, an anchoring means having a wavy surface on each of its opposite surfaces and a holding means also having a wavy surface to engage with the anchoring means may be used as a holding mechanism.

The above described embodiments are pre-stressed concrete plates. However, application of the present invention is not restricted to such flat structures. The method can be used for fabrication of such more massive structures as columns and beams, for example. Further, by using a swelling concrete, pre-tension is automatically given to the concrete member. By this method, three dimensionally pre-stressed member is obtained.

Another embodiment of the method for fabricating the above-mentioned pre-tensioned column will be described as follows. This is a method for fabricating a pre-stressed column or beam wherein the reinforcement members are disposed three-dimensionally as shown in FIG. 24.

Figure 25:
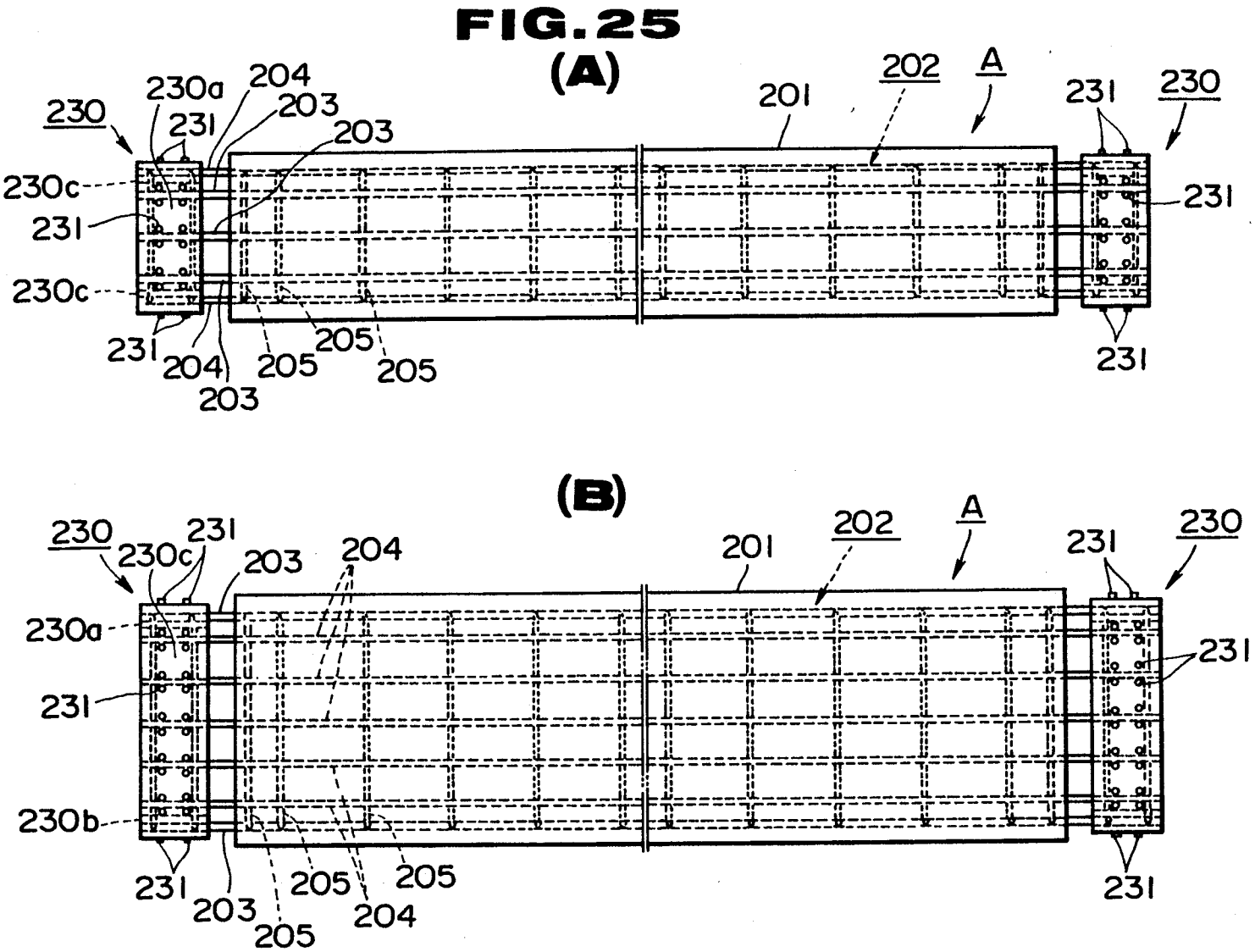
FIG. 25 shows two groups of hook means, one group opposing the other in a spaced relation.
Figure 26:
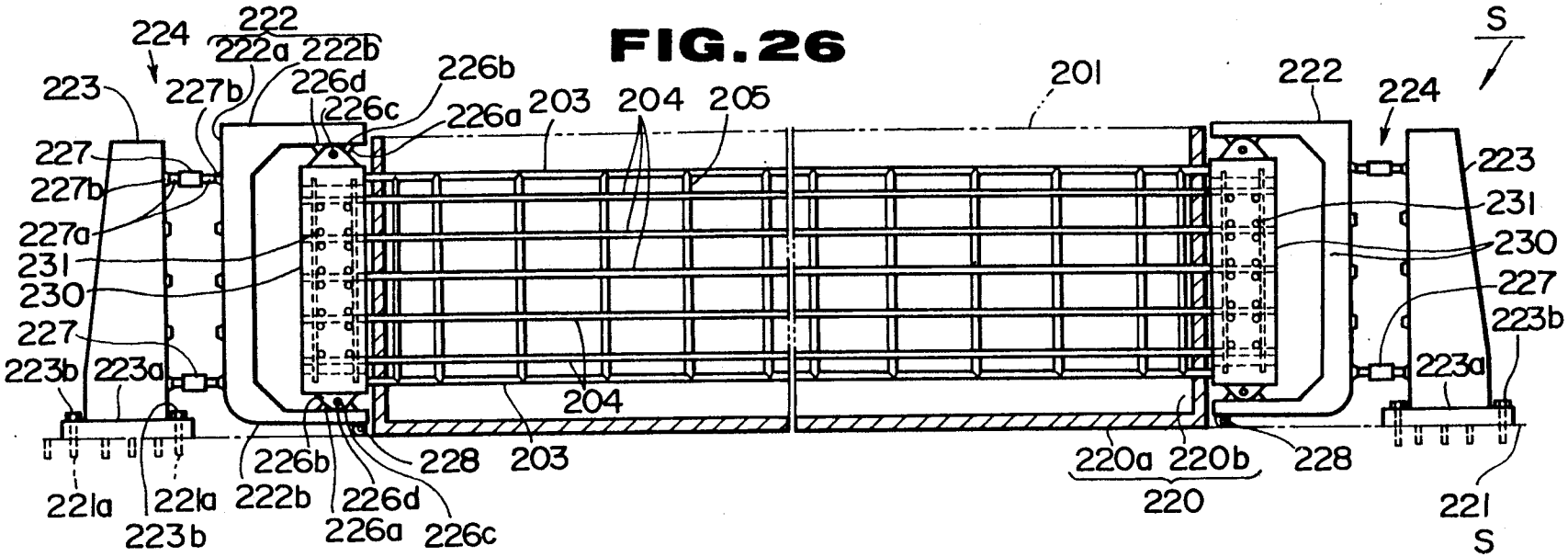
FIG. 26 shows a U-shaped holding means connected to each of the anchoring means by means of a pair of hinges.

First two groups of hook means 231 are prepared, one group opposing to the other group in a spaced relation to each other as shown in FIG. 25. By hooking each extremity thereof at the hook means 231, a reinforcement member 202' as shown in FIG. 24 is fabricated to extend between the hook means 231. Then a pair of molds are assembled to enclose the respective group of the hook means 231 together with the reinforcement members 202'. Then a material such as concrete or resin is poured in the mold. When the material is solidified, an anchoring means 230, attached at both ends of the reinforcement member 202', is obtained. Two stirrup reinforcement members are embedded in the anchoring means 230. Then a handle 226 is attached to the hook means 231 projecting out of the side face of the anchoring means 230. A U-shaped holding means 222 comprising a flat base portion 222*a* and a flange portion 222*b* is connected to each of the anchoring means 230 by means of a pair of hinges 226*a*, 226*b*, 226*c*, 226*d*. The anchoring means 230 is supported by the holding means 222 at its two side faces. The holding means 222 attached to the respective anchoring means 230 is connected to respective reaction structure 223 through a plurality of jacks 227, 224. The reaction structure 223 is fixed to the basement by anchor bolts 221*a*, 221*b* threading its base flange 223*a*. The jacks 224, 227 may be replaced by as many tie rods.

A mold 220, comprising a bottom plate 220*a* and side plates 220*b* defining a rectangular parallelepiped space therein, for molding a pre-stressed concrete member 201 is assembled to contain a substantial part of the reinforcement member except the anchoring means 230 attached at their two extremities.

Figure 27:
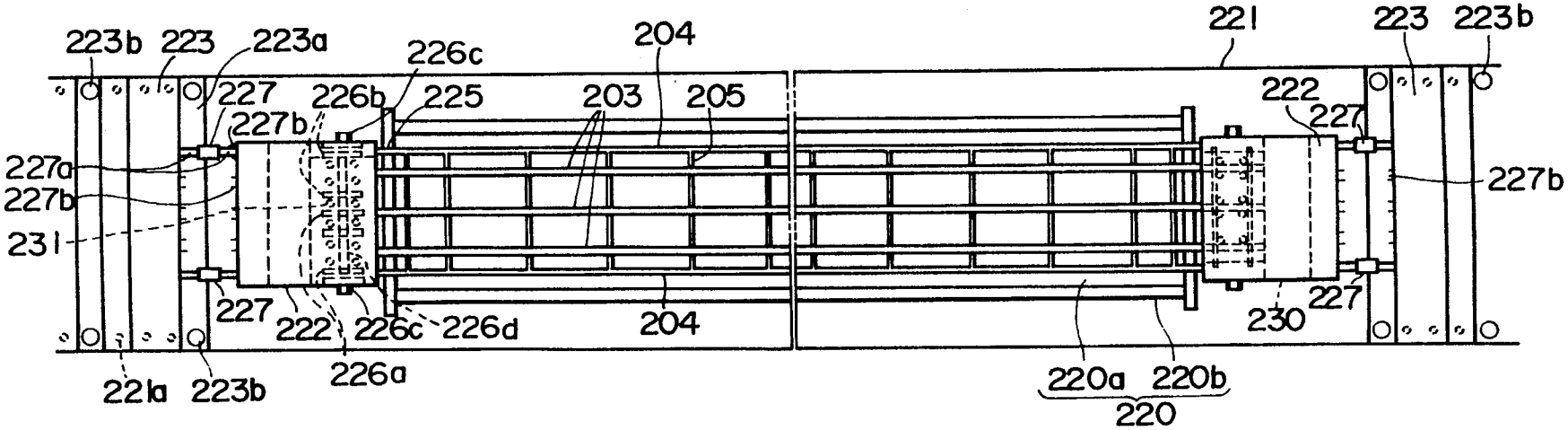
FIG. 27 shows apparatus for giving pre-stress to the concrete means.

The jacks 224, 227 pulls the anchoring means 230 so as to give a pre-stress to the longitudinal reinforcement members 203, 204. Concrete is poured in the mold 220 as maintaining the pre-stress acting in the reinforcement members 203, 204. When the concrete is solidified, tension of the jack 224, 227 is realized, and the reinforcement member 203, 204 extruding from the mold 220 is cut to set free the mold 220 and the concrete member 201 off the anchoring means 230. FIG. 27 shows the apparatus for giving pre-stress to the concrete member seen from above.

Figure 28:
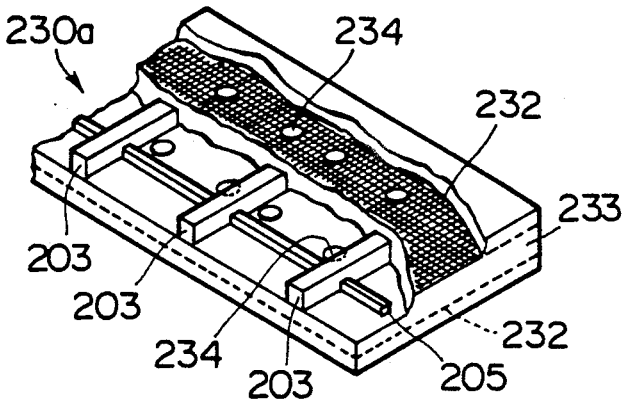
FIG. 28 shows a modified embodiment of the anchoring means.

FIG. 28 shows a modified embodiment of the anchoring means 230*a* which comprises reinforcement members 203 and stirrup reinforcement members 205 both embedded therein, a fiber mesh for strengthening the anchoring means, and resin material or concrete body embedding them therein. Through-holes 234 are formed through the thickness of the anchoring means 230*a*. By virtue of the through-holes 234, the anchoring means 230*a* can be connected to a holding means which is connected to the jack means.

As described above, by virtue of the pre-stressed concrete member according to the present invention, there is provided a concrete member which is strong, light, durable, and corrosion resistant. The characteristics is derived by the construction of the present concrete member, more specifically, derived by the fact that a resin bound unitary grid reinforcement structure, having a strong intersections therein, is used as a reinforcement member. Corrosion resistance of the present concrete member is derived by the corrosion resistance of the reinforcement member which is composed mainly of corrosion resistant fiber strands and a resin binding. Further, by virtue of a large deformability and relatively small Young's modulus of the reinforcement member, intensity of the pre-stress is stable against prospective shrinkage and creep deformation of the concrete. By the method for fabricating pre-stressed reinforced concrete member according to the present invention, it becomes possible to fabricate the same quickly and effectively. The method does not require large instruments and elaborate works unlike the fabrication of post-tension concrete members. Therefore, productivity and workability of the fabrication of non-metallic member reinforced concrete member is largely improved.

What is claimed is:

1. A pre-stressed reinforced concrete member comprising:

(a) a concrete body defining the reinforced concrete member;

(b) at least one reinforcing grid member embedded in the concrete body, each grid member having first elongated reinforcing members under tensile pre-stress and second elongated reinforcing members, both members intersecting each other at intersections, each of the first and second elongated reinforcing members including stacked rows of textiles laid on top of the other and resin impregnating and fuse-bonding the textiles and the rows to one another, the stacked rows of textiles included in the first and second elongated reinforcing members crossing and interleaving alternately at the intersections to fuse bond the first elongated reinforcing members and the second elongated reinforcing members to each other; and (c) anchoring means for anchoring the first elongated reinforcing members to give tensile pre-stress to the first elongated reinforcing members, the anchoring means being disposed and embedding both end portions of the first elongated reinforcing members to be integrated to the first elongated reinforcing members, (d) wherein the anchoring means is composed of a plurality of anchoring blocks with slits formed therebetween, the anchoring means being connected to both extremities of the first elongated reinforcing members, each slit having a concave portion at a mid-part of the surface opposing to each thereover, wherein the slit is used for giving tensile pre-stress to the first elongated members, (e) whereby the grid member tightly grips the concrete body so as to firmly and uniformly transmit the pre-stress thereof to the concrete body, along a whole length thereof, both by bond between the grid member and the concrete member and by mechanical anchoring at the intersections between the grid member and the concrete body.

2. A pre-stressed concrete member according to claim 1, wherein:

(a) said textiles are formed in strands, and (b) said textiles are made of at least one fiber selected from the group consisting of a carbon fiber, a glass fiber, a synthetic resin fiber, a ceramic fiber, and a metallic fiber.

3. A pre-stressed concrete member according to claim 2, wherein said resin matrices are each made of at least one substance selected from the group consisting of a vinyl ester resin, a non-saturated polyester, an epoxy resin, and a phenolic resin.

4. A pre-stressed concrete member according to claim 3, wherein said first elongated reinforcing members and said second elongated reinforcing members each contain about 30% to about 70% by volume of a glass fiber and about 70% to about 30% by volume of a vinyl ester resin.

5. A pre-stressed concrete member according to claim 3, wherein said first elongated reinforcing members and said second elongated reinforcing members each contain about 20% to about 60% by volume of a carbon fiber and about 80% to about 40% by volume of a vinyl ester resin.

6. A pre-stressed concrete member according to claim 1, wherein said first elongated reinforcing member is extended straigth and pre-tensioned, said second elongated reinforcing member has a closed form, and a columnar space is defined by said first elongated reinforcing member and said second elongated reinforcing member.

7. A pre-stressed concrete member according to claim 6, wherein the pre-stressed concrete member comprises at least two pre-stressed reinforced concrete units.

8. A pre-stressed concrete member according to claim 6, wherein the second elongated reinforcing members are stirrups.

9. A pre-stressed concrete member according to claim 8, wherein stirrups are partially overlapping one another.

* * * * *